US010890011B2

(12) United States Patent
Andersson

(10) Patent No.: US 10,890,011 B2
(45) Date of Patent: Jan. 12, 2021

(54) CYLINDER LOCK AND KEY SYSTEM

(71) Applicant: ASSA ABLOY Opening Solutions Sweden AB, Eskilstuna (SE)

(72) Inventor: Daniel Andersson, Eskilstuna (SE)

(73) Assignee: ASSA ABLOY OPENING SOLUTIONS SWEDEN AB, Eskilstuna (SE)

( * ) Notice: Subject to any disclaimer, the term of this patent is extended or adjusted under 35 U.S.C. 154(b) by 238 days.

(21) Appl. No.: 16/084,015

(22) PCT Filed: Feb. 8, 2017

(86) PCT No.: PCT/EP2017/052747

§ 371 (c)(1),
(2) Date: Sep. 11, 2018

(87) PCT Pub. No.: WO2017/157586

PCT Pub. Date: Sep. 21, 2017

(65) Prior Publication Data

US 2020/0291679 A1 Sep. 17, 2020

(30) Foreign Application Priority Data

Mar. 16, 2016 (EP) ..... 16160559

(51) Int. Cl.

| | |
|---|---|
| ***E05B 27/00*** | (2006.01) |
| ***E05B 19/04*** | (2006.01) |
| ***E05B 19/00*** | (2006.01) |
| *E05B 9/04* | (2006.01) |

(52) U.S. Cl.
CPC ..... *E05B 27/0042* (2013.01); *E05B 19/0011* (2013.01); *E05B 19/04* (2013.01);
(Continued)

(58) Field of Classification Search
CPC .. E05B 27/0042; E05B 19/04; E05B 19/0011; E05B 27/0017; E05B 27/001;
(Continued)

(56) References Cited

U.S. PATENT DOCUMENTS 2,065,294 A * 12/1936 Reuben ..... E05B 19/00 76/110
3,861,181 A * 1/1975 Needham ..... E05B 29/00 70/492

(Continued)

FOREIGN PATENT DOCUMENTS

| | | | |
|---|---|---|---|
| AT | 4293 U1 | * | 5/2001 |
| DE | 816803 C | * | 11/1951 |
| EP | 2360333 A2 | * | 8/2011 |

*Primary Examiner* — Lloyd A Gall
(74) *Attorney, Agent, or Firm* — Babcock IP, PLLC

(57) ABSTRACT

A cylinder lock and key system. The plugs comprise a housing having a cylindrical bore; and a cylindrical plug which is rotatable and which exhibits a front end and a keyway. The keys comprise a key bow; and a key blade is rotatable about the rotational axis when inserted. The plugs and keys are provided with cooperating stop surfaces for defining the fully inserted position of the keys. At least one first stop surface is in contact with a corresponding second stop surface when a key is inserted in the keyway of a lock. At least two first stop surfaces of each key are arranged adjacent each other and at least two second stop surfaces of each lock are arranged adjacent each other, at or in proximity to the keyway. A cylinder lock and key combination, a key, a key blank and a cylinder lock are also disclosed.

20 Claims, 18 Drawing Sheets

(52) U.S. Cl.
CPC ..... *E05B 27/0017* (2013.01); *E05B 9/041* (2013.01); *E05B 27/001* (2013.01); *E05B 27/0053* (2013.01)

(58) Field of Classification Search
CPC .. E05B 27/0053; E05B 9/041; E05B 19/0017; E05B 19/0029; E05B 19/0052; E05B 19/0094; E05B 35/10; E05B 15/06
USPC ..... 70/453, 454, 419, 420, 375, DIG. 62, 70/337, 372, 402, 405–409
See application file for complete search history.

(56) References Cited

U.S. PATENT DOCUMENTS 5,088,306 A * 2/1992 Field ..... E05B 15/08 70/375
5,488,843 A * 2/1996 Shi ..... E05B 17/2092 70/1.5
5,513,509 A * 5/1996 Bergen ..... E05B 27/00 70/409
6,155,090 A * 12/2000 Rubensson ..... E05B 15/08 70/367
6,973,814 B2 * 12/2005 Keller ..... E05B 27/0053 70/395
8,806,908 B2 * 8/2014 Yu ..... E05B 35/12 70/337
2010/0319422 A1 * 12/2010 Lienau ..... E05B 19/0023 70/493
2016/0145896 A1 * 5/2016 Ulrich ..... E05B 35/001 70/373

* cited by examiner

Cylinder lock/plug No.

| Key No. | 1<br>-1 -1 | 2<br>-1 0 | 3<br>-1 1 | 4<br>0 -1 | 5<br>0 0 | 6<br>0 1 | 7<br>1 -1 | 8<br>1 0 | 9<br>1 1 |
|---|---|---|---|---|---|---|---|---|---|
| 1 -1 -1 | | | X | | | X | X | X | X |
| 2 -1 0 | | X | | | X | | X | X | |
| 3 -1 1 | X | | | X | | | X | | |
| 4 0 -1 | | | X | X | X | X | | | |
| 5 0 0 | | X | | X | X | | | | |
| 6 0 1 | X | | | X | | | | | |
| 7 1 -1 | X | X | X | | | | | | |
| 8 1 0 | X | X | | | | | | | |
| 9 1 1 | X | | | | | | | | |

Fig. 12

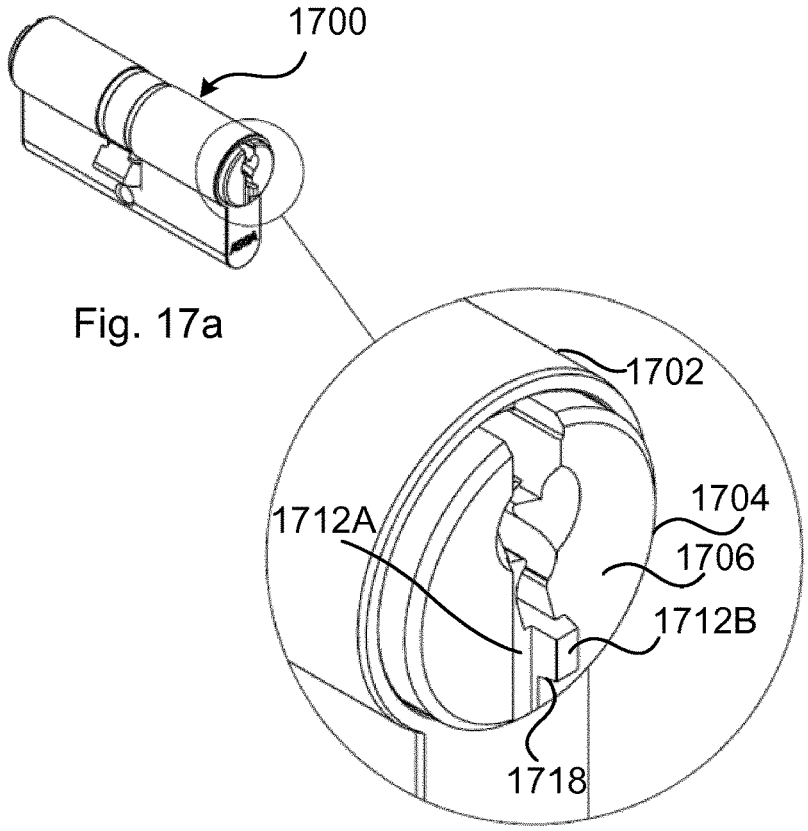
Fig. 17a
Fig. 17b
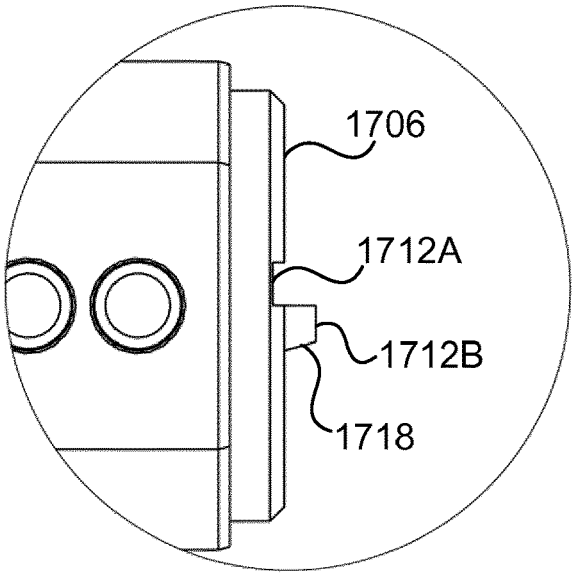
Fig. 17c

CYLINDER LOCK AND KEY SYSTEM

BACKGROUND

The invention concerns a cylinder lock and key system comprising a plurality of cylinder locks and a plurality of keys, each key being arranged for operating at least one of the cylinder locks. Particularly, the invention concerns a master key system wherein at least one key is arranged to operate several of the locks comprised in the system. The invention also concerns a cylinder lock and a key for such a system as well as a key blank for producing a key for such a system.

Cylinder locks comprise a housing or stator with a cylindrical axial bore housing a cylindrical rotatable plug, core or rotor. The plug exhibits an axial keyway for insertion of a key provided with a code. The plug is further provided with code sensing members which detect the code of the inserted key and which allows rotation of the plug in the housing only when a key having a correct code, which corresponds to the lock in question, is fully inserted into the keyway.

There exist several general types of cylinder locks, such as pin tumbler locks and disc tumbler locks. The pin tumbler locks comprise radially displaceable pin tumblers which are arranged in the plug and housing, to sense or detect a code arranged at an edge and/or a side of the key blade. Keys where the code is formed as axially spaced code surfaces arranged at different heights or radial positions along the edge of the key blade normally exhibits a saw teeth like shape and are sometimes referred to as cut keys or conventional notched keys. Another type of keys is the so called dimpled keys, where the code is formed of a number of normally conical recesses formed in the sides and/or edges of the key blade. These and other general types of cylinder locks and corresponding keys are well known in the art and are not further described here.

In order for the code sensing members to be able to correctly detect the code of the key, the key needs to be inserted to a well defined position in the keyway when detection is made. This position is normally referred to as the fully inserted position of the key in the keyway. Traditionally, the fully inserted position is defined by a collar or shoulder arranged on the key, at the junction between the key blade and the key bow. The shoulder exhibits a stop surface which is facing the front end of the plug and the front end of the plug exhibits a corresponding stop surface. For operating the lock from its locked to its unlocked mode, the key is inserted until the two stop surfaces make mutual contact and prevent further insertion of the key. The key has then reached the fully inserted position, at which the code sensing members of the plug are radially aligned with the respective intended code surfaces of the key. If the key is a correct key, i.e. a key having the correct code for the lock in question, the code surfaces of the key, at this key position, are arranged such that the code sensing members will release the plug from the housing. Thereby the plug may be rotated relative to the housing, e.g. by means of the key bow, for manoeuvring the lock to its unlocked mode.

Lock and key systems referred to as master key systems are systems comprising a plurality of locks and keys which are arranged in a hierarchic order. For example, some keys may be configured to operate only a one respective lock, whereas other keys may be configured to operate several different locks and one or several yet other keys, so called grand master keys, may be configured to operate all locks in the system. Correspondingly some locks may be configured to be operated by only one key at each hierarchic level, whereas other locks may be configured to be operated by several keys at each hierarchic level. Such master key systems find great use e.g. in office buildings, hospitals, within companies and the like, where it is desirable to control the access to certain doors for each key holder. However, less complicated master key systems are also frequently used at e.g. apartment blocks where e.g. tenants should have access to only one or a few doors, whereas landlords and service personnel should have access to several and in some instances all doors in the building.

Especially at comparatively complicated master key systems involving great numbers of locks and keys as well as many hierarchic levels and sophisticated access combinations it is of great importance that the possible number of permutations for the correct lock and key code combinations are high. One way of increasing the number of possible permutations in a system is to increase the number of pin or disc tumblers in the plugs and the corresponding number of axial code surface positions at the keys. Another way is to increase the number of selectable code heights at each axial code surface position at the keys, i.e. to decrease the pitch between the possible code heights for each pin or disc tumbler. Yet another way to increase the number of permutations in a system is to vary the profiles, i.e. the cross sectional shapes of the keyway and the key blades. However, these ways of increasing the number of possible permutations of a system are limited and, in practice suffer from some disadvantages. It would therefor be advantageous to find another simple, reliable and readily applicable way to increase the number of possible permutations in master key systems.

PRIOR ART

EP 0 637 663 B1 discloses a key and lock combination wherein the key is provided with a first stop surfaces for defining the fully inserted position when inserting the key into the lock and a further stop surface for defining the fully inserted position when the key is inserted into a key copying machine. By separating the two stop surfaces axially from each other it is achieved that unauthorized persons can not produce a true copy of an original key by means of fully inserting a key blank into a regular key copying machine.

EP 1523 603 B1 discloses a lock and key combination wherein a reversible key is provided with two shoulders arranged at a respective edge of the key blade. Each shoulder exhibits a forwardly facing stop surface and is provided with a recess forming a laterally facing additional control surface. The lock comprises a plug provided with a keyway and a recess formed in the front end of the plug. The recess defines a forwardly facing stop surface interacting with one of the stop surfaces of the key and a laterally facing additional control surface interacting with a corresponding one of the lateral control surfaces of the key. By this means, it is possible to increase possible variations of the cross sectional profiles of the corresponding keyways and key blades.

U.S. Pat. No. 2,065,294 discloses a lock and key combination wherein a non-reversible key is provided with two stop surfaces arranged at opposite edges of the key blade. One of the stop surfaces is arranged at the coded edge of the key blade and the other stop surface is arranged at the spine edge of the key blade. The core is provided with two corresponding stop surfaces each cooperating with a respective one of the key's stop surfaces. By utilizing two pairs of stop surfaces the number of permutations may be increased.

AT 004 293 U1 describes a cylinder lock and a key which cylinder lock comprises a profiled stop area and which key comprises a corresponding profiled stop area for defining the insertion depth of the key in a key channel of the cylinder lock.

SUMMARY OF THE INVENTION

It is an object of the present invention to provide an enhanced cylinder lock and key system.

Another object is to provide such a system which exhibits a high degree of security and which renders it difficult to wrongfully produce unauthorized keys.

A further object is to provide such a system at which a comparatively high number of possible permutations may readily be achieved.

Yet another object is to provide such a system which is reliable in use.

Still an object is to provide such a system at which the cylinder locks and the keys are backward compatible such that cylinder locks and keys according to the invention may be utilized in already existing systems.

A still further object is to provide such a system at which the cylinder locks may be of the modern type having plugs in which the keyway extends radially in one direction all the way to the periphery of the plug, thereby forming a keyway which is open in one radial direction.

These and other objects are achieved by a cylinder lock and key system as disclosed herein. The cylinder lock and key system thus comprises cylinder locks and keys. The cylinder locks are of the kind comprising a housing having a cylindrical bore; and a cylindrical plug which is rotatably journaled in the housing about a rotational axis and which exhibits a front end and a keyway which extends axially from an entrance opening at the front end. The keys are of the kind comprising a key bow; and a key blade which is insertable in a forward direction to a fully inserted position in the keyway of corresponding locks and rotatable about the rotational axis when inserted. The plugs and keys are provided with cooperating stop surfaces for defining the fully inserted position of the keys in the keyways. The cooperating stop surfaces comprise at least two first stop surfaces arranged at each key, each first stop surface facing forward in the insertion direction and being positioned at a selected one of a predetermined number of selectable axial positions; and at least two second stop surfaces arranged at the front end of each plug, each second stop surface facing forward relative to the plug and being positioned at a selected one of the predetermined number of selectable axial positions. The first and second stop surfaces are arranged such that at least one first stop surface is in contact with a corresponding second stop surface when a correct key is fully inserted in the keyway of a corresponding lock. The code exhibits a code cut angle $\alpha$ and code surfaces which are radially separated by an integer multiple of a code surface pitch, p. The selectable axial positions for the first and second stop surfaces are axially separated by a stop separation distance x, wherein $x \geq 0.5*p*\tan \alpha$ By arranging at least two forwardly facing first stop surfaces at axially selectable positions on the key and a corresponding number of oppositely facing second stop surfaces at a corresponding number of selectable positions it is possible to require that any key and lock combination exhibits a correct configuration of the first and second stop surfaces for allowing the key to be inserted into the fully inserted position. By this means it is possible to define a number of possible permutations for the system merely by arranging the stop surfaces at different axial positions. It is for example possible to provide the keys with two first stop surfaces which each may be positioned at any one of three different selectable axial positions and the plugs with two corresponding second stop surface which also may be positioned at any one of three corresponding selectable positions.

Hereby it is possible to achieve $3^2=9$ possible combinations merely by means of the cooperating stop surfaces. The system may also be given permutations in a traditional manner by the arrangement of the tumblers and the code surfaces on the keys as well as by variation of the keyway and key blade profiles. In this example, the total number of possible system permutations equals the number of traditionally accomplished permutations multiplied by 9. The cooperating first and second stop surfaces thus provides for that the total number of system permutations may be manifold increased in a simple and yet reliable manner. By varying the stop surface combinations it is also possible to distinguish different groups of lock and key combinations e.g. within a master key system. For example the stop surface combinations may be used to differentiate lock and key combinations that are intended for different countries, different retailers or different customers and the like.

By setting the smallest stop surface separation distance in relation to the geometry of the code, it is assured that the pin tumblers of a lock will be sufficiently radially displaced when inserting a key comprised in the system but intended not to open this particular lock. Such sufficient displacement of the pin tumblers results in that the ends of the pin tumblers are not positioned in proximity to the shear line such that the plug may be forced to rotate when inserting a key not having the correct first stop surface configuration.

The stop separation distance x may be selected smaller than $0.8*p*\tan \alpha$. Hereby it is achieved that the pin tumblers are not displaced a full pitch to coincidentally be positioned where the end of the pin tumblers lie at or in proximity to the shear line.

The first stop surfaces may be arranged adjacent each other and the second stop surfaces adjacent each other, at or in proximity to the entrance opening of the keyway. This results in a comparatively complex three dimensional shape which is not easy to reproduce without the use of advanced modern machining equipment. Thereby, wrongful production or copying of keys by unauthorized persons is made difficult such that the security of the system is increased.

On the other hand, by the use of modern authorized key blank production machines and key copying machines, the first and second stop surfaces may readily be accomplished at low cost. The invention thus provides for that authorized person may readily produce locks and keys for the inventive system, thereby benefitting from the advantages of the system.

The keys may be flat keys, where the key blades exhibit two mutually opposing sides and two mutually opposing edges joining the opposing sides and the first stop surfaces may then be arranged at or in proximity to a common first edge.

The specific arrangement of the first stop surfaces at or in proximity of a common edge further provides for that the desired multiple first and second stop surface configuration may be applied also to systems comprising cylinder locks of the modern and widely spread type where the cylinder plug exhibits keyways which are open in one radial direction, i.e. where the keyways are formed as a radial slit in the plug.

Thus, the keyway and the entrance opening of each lock may be open in one radial direction and the second stop surfaces may be arranged at a radially closed end of the entrance opening being opposite to the radially open end.

The first edge of the key blade may be an edge which, in the fully inserted position, is positioned proximal to the radially closed end of the keyway.

The first stop surfaces may be arranged mutually side by side on either side of an imaginary radial line of the key blade and the second stop surfaces may be arranged mutually side by side on either side of an imaginary radial line of the plug.

Alternatively or in combination, the first stop surfaces may be arranged at mutually different radial positions of the key blade and the second stop surfaces may be arranged at mutually different radial positions of the plug.

When these two configurations of the first and second stop surfaces are combined, the resulting three dimensional shape of the combined stop surfaces exhibits a comparatively complex geometry which is difficult to reproduce without the use of modern authorized equipment.

The first and second stop surfaces may be generally planar.

The first and second stop surfaces may be arranged in parallel with the cross sectional planes of the key blade and the plug respectively.

The number of selectable axial positions for the first and second stop surfaces may be 2-5, preferably 3.

The selectable axial positions for the first and second stop surfaces may be equidistantly separated.

The keys may be reversible and comprise at least two primary first stop surfaces arranged at or proximity to the first edge of the key blade and at least two secondary first stop surfaces arranged at or proximity the second edge of the key blade, which secondary first stop surfaces may be arranged symmetrically to the primary first stop surfaces with respect to a central axis of the key blade. By this means the key may be made reversible.

At least one second stop surface may be arranged in a recess formed in the front end of the plug.

The first stop surfaces may be arranged at or in proximity to the junction between the key blade and the key bow.

The cylinder locks may comprise pin tumbler locks or disc tumbler locks and the keys may be of the conventional notched or cut key type, dimpled key type, engraved key type, side coded key type or disc cylinder key type.

The selectable axial positions for the first and second stop surfaces may be equidistantly separated by a stop separation distance; each of the first stop surfaces being positioned at a selected one of the predetermined number of a respective set of selectable axial positions, the selectable positions of one set being axially offset to at least one other set and each of the second stop surfaces may be positioned at a selected one of the predetermined number of a respective set of selectable axial positions, the selectable positions of one set being axially offset to at least one other set.

At least two sets of selectable axial positions for the first stop surfaces may be mutually axially offset by half the equidistant stop separation distance and at least two sets of selectable axial positions for the second stop surfaces may be mutually axially offset by half the equidistant stop separation distance.

At least one second stop surface may be arranged on an insert which is removably fixed to the plug.

The invention also relates to a cylinder lock and key combination, a key for a cylinder lock and key system of the above described type, a key blank for producing such a key and to a cylinder lock for such a system. The cylinder lock and key combination, the key, the key blank and the cylinder lock exhibit objectives, features and advantages corresponding to those of the system.

The first and second stop surfaces may thus be applied to cylinder lock and key combinations comprising merely one cylinder lock and one or a few keys. At such cases, the comparatively complex three dimensional shape of the first stop surfaces will make unauthorized key production and key copying difficult. Additionally, the possible first and second stop surface combinations may be used for differentiating several lock and key combinations one from the others. Correspondingly, when the first stop surfaces are applied to keys and key blanks, unauthorized key production and key copying is prevented or made difficult.

Further objects and advantages of the invention appear from the description of embodiments below and from the appended claims.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. If not specified differently, a radial direction of a key is to be understood as a direction which is radial to the axis of rotation when the key is inserted in a plug and rotated therewith.

BRIEF DESCRIPTION OF THE DRAWINGS

In the following detailed descriptions of exemplifying embodiments will be given with reference to the figures, in which:

FIG. 6*a* is a longitudinal section through a cylinder lock with an inserted key and FIG. 6*b* is a partial magnification thereof. Whereas

FIG. 12 is a schematic diagram representing the keys and cylinder locks in a master key system according to the invention.

FIG. 17*a* is a perspective view of a cylinder lock according to a further embodiment. FIG. 17*b* shows a detail thereof in enlarged scale and FIG. 17*c* is a bottom view of the detail shown in FIG. 17*b*

DETAILED DESCRIPTION OF EMBODIMENTS

Figures 1A, 1B:
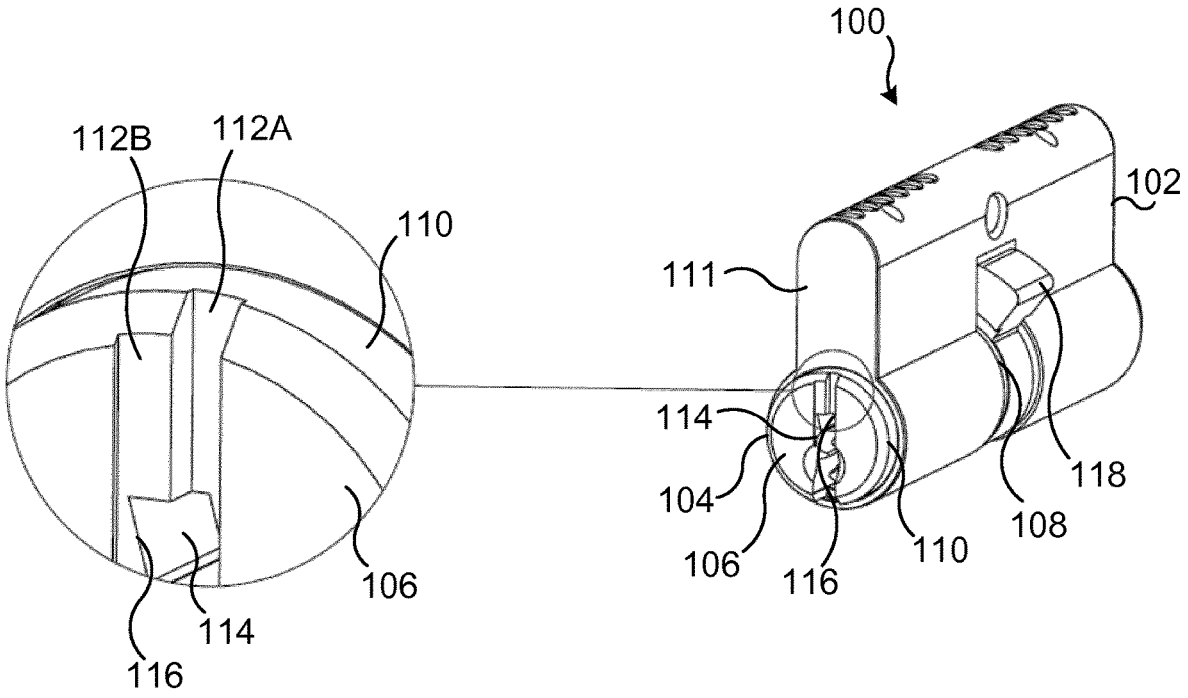
FIG. 1*a* is a perspective view of a cylinder lock forming part of a system according to an embodiment of the invention.
FIG. 1*b* shows a portion in enlarged scale of the lock shown in FIG. 1*a* and FIG. 1*c* is a perspective view of a key forming part of the system.
Figure 1C:
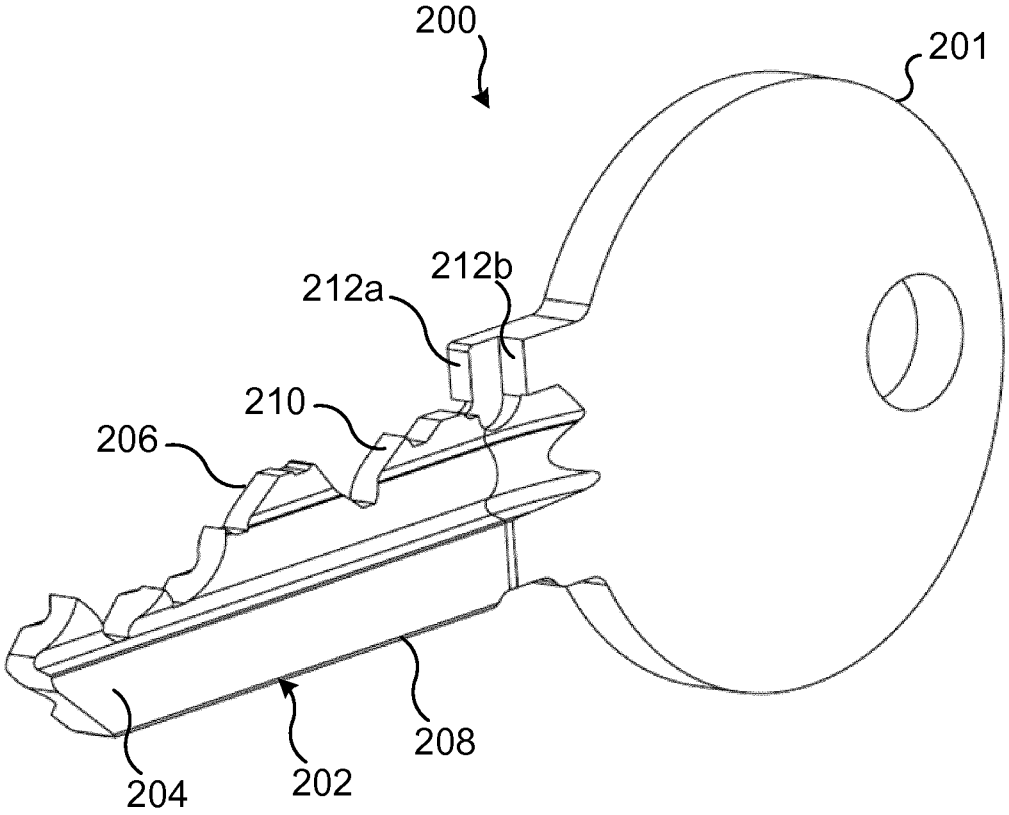

FIG. 1*a* illustrates a cylinder lock 100 which forms part of a cylinder lock and key system according to the invention and FIG. 1*b* shows in enlarged scale a detail of the lock 100. FIG. 1*c* illustrates a corresponding correct key 200 for the cylinder lock 100 shown in FIG. 1*a*. The cylinder lock is a double cylinder pin tumbler lock and comprises a stator or housing 102 with a cylindrical bore. A first cylindrical rotor or plug 104 is received in the bore, rotationally about a longitudinal rotational axis. A second plug (not shown) is received in a bore arranged at the opposite portion of the housing. In the following only the plug 104 shown in the figures will be described. It is however evident that the second plug may be identical with the first plug 104. The plug 104 exhibits a front end 106 and a rear end 108. The plug 104 is provided with an radially enlarged extension 110 which protrudes forwardly, passed a front surface 111 of the housing 102, such that the front end 106 is arranged in front of the front surface 111 of the housing 102. The plug 104 exhibits a profiled keyway 114 which extends longitudinally backwards from an entrance opening 116 at the front end 106 of the plug. The keyway 114 extends in one radial direction to the periphery of the plug 104. The keyway 114 is thus radially open and forms a radial slit in the plug 104.

The housing 102 and plug 104 are provided with pin tumbler channels receiving upper and lower pin tumblers (not shown) which are arranged to prevent rotation of the plug 104 if not a correct key has been fully inserted in the keyway and to allow rotation when such a key has been fully inserted. When a correctly cut key blade is fully inserted into the keyway, each pair of lower and upper tumbler pins will be positioned with their abutting upper and lower contact surfaces located at a shear line between the rotatable key plug and the stationary housing, so as to enable a turning motion of the key plug in relation to the housing. If an incorrectly cut key is inserted into the key channel, at least one upper or lower pin tumbler will be positioned such that it intersects the shear line to thereby prevent rotation of the plug relative to the housing.

The plug 104 is provided with a radially protruding cam 118 which follows rotation of the plug for actuating a lock mechanism, e.g. in a lock casing, upon rotation of the plug 104. Such pin tumbler arrangements and cams 118 are well known in the art and are not further described herein.

As seen in FIG. 1*c*, the key 200 comprises a key grip or bow 201 arranged at a rear end of the key 200. A profiled key blade 204 extends forwardly in the insertion direction of the key 200 from a front portion of the key bow 201. The profile of the key blade 202 corresponds to the profile of the keyway 114 such that the key blade 202 may be inserted in the keyway 114. The key blade exhibits two opposed lateral sides 204, 206 and two opposed edges 208, 210 connecting the two sides. The upper edge 210 is provided with a cut out code arranged to cooperate with the pin tumblers in the plug 104, when the key blade 202 is inserted in the keyway 114, in a manner known in the art.

In accordance with the invention, the key 200 is provided with two first stop surfaces 212*a*, 212*b*. The two first stop surfaces 212*a*, 212*b* are arranged at that edge 210 of the key blade 202, which exhibits the code. In the embodiment shown in FIG. 1*c*, the two first stop surfaces are arranged side by side on either side of an imaginary radial line of the key blade 202. By imaginary radial line is meant an imaginary line which extends in a radial direction relative to the rotational axis when the key 200, inserted in the keyway 114, is rotated together with the plug 104. As clearly seen in FIG. 1*c* the two first stop surfaces 212*a*, 212*b* are positioned at mutually different axial positions in relation to the key blade 202. In the shown example first surface 212*a* is positioned axially forward of first stop surface 212*b*. Both first stop surfaces 212*a*, 212*b* are planar and arranged in parallel with the cross sectional plane of the key blade 202. The first stop surfaces 212*a*, 212*b* are further positioned at the junction between the key bow 201 and the key blade 202.

Now turning to FIGS. 1*a* and 1*b*, the plug 104 is provided with two second stop surfaces 112A, 112B. The two second stop surfaces 112A, 112B are arranged at the front end 106 of the plug 104 and defined by the bottom wall of a respective recess formed axially in the extension 110 of the plug 104. The second stop surfaces 112A, 112B are further arranged side by side at either side of an imaginary radial line of the plug 104. Additionally, the second stop surfaces 112A, 112B are arranged at the radial end of the keyway 114 which is opposite to the radially open end of the keyway 114. The two second stop surfaces 112A and 112B are separated axially such that they are arranged at different axial positions of the plug, the second stop surface 112B being positioned forward of the second stop surface 112A.

At the example shown in FIGS. 1*a*-1*c* the axial distance between the two second stop surfaces 112A and 112B is equal to the axial distance between the two first stop surfaces 212*a* and 212*b*. Hence, at this example, one first stop surface 212*a* will make contact with the corresponding second stop surface 112A and the other first stop surface 212*b* will simultaneously make contact with the corresponding second stop surface 112B during insertion of the key blade 202 into the keyway 114. When these simultaneous mutual contacts occur, further insertion of the key blade 202 into the keyway 114 is prevented and the key has thus reached is fully inserted position. Since, in this example, the key 200 is a correct key for the lock 100, this fully inserted position results in that the intended code surfaces of the key blade 202 are aligned with the corresponding pin tumbler channels in the plug 104, such that the pin tumblers are displaced to their respective releasing positions and the plug is released from the housing for allowing rotation of the plug 104.

Figures 2A, 2B:
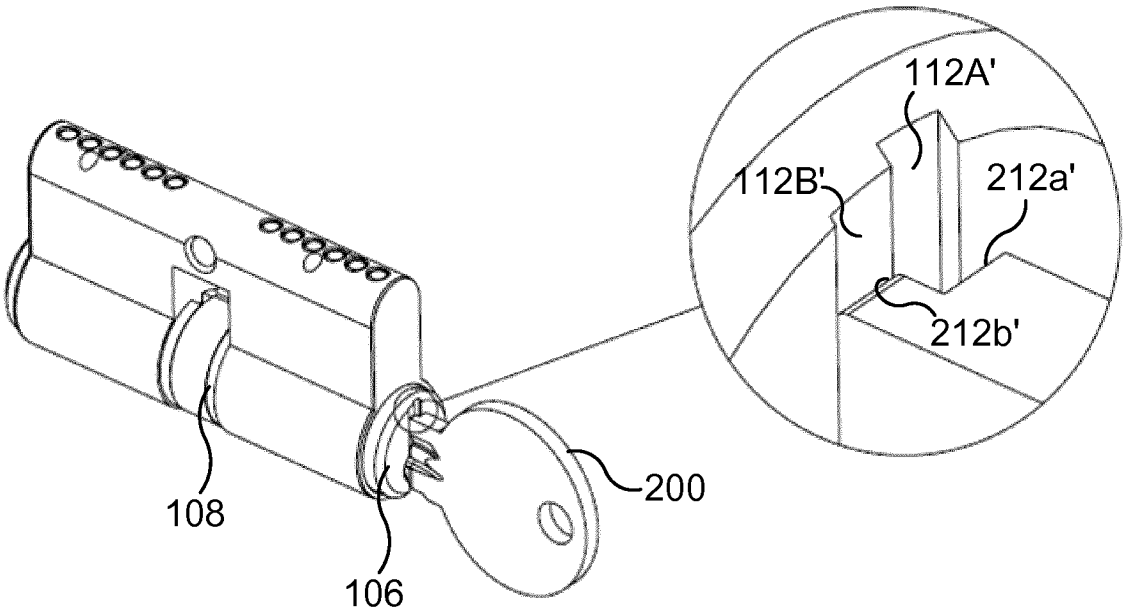
FIG. 2*a* is a perspective view of a lock with a corresponding key inserted and FIG. 2*b* is a partial magnification thereof.

However, and as illustrated in FIG. 2*a*-*b* both first stop surfaces 212*a*' and 212*b*' need not to be in contact with a corresponding second stop surface 112A', 112B' for defining the correct fully inserted position. Here, only one first stop surface 212*b*' makes contact with the corresponding second stop surface 112B' for defining the correct fully inserted position. At this example first stop surface 212*a*' is arranged axially behind first stop surface 212*b*' and second stop surface 112A' is arranged axially behind second stop surface 112B' such that this pair of first 212*a*' and second 112A' stop surfaces may not come in mutual contact.

Now, the different keys and cylinder locks comprised in the system according to the invention may be varied by positioning the first and second stop surfaces at any respective axial position out of a predetermined number of selectable axial positions. FIGS. 3*a*-5*b* illustrates schematically a system at which each first 412*a*, 412*b* and second 312A, 312B stop surface may be positioned at any one of three selectable axial positions. The key 400 shown in FIGS. 3*a*-4*b* constitutes key no. 7 in FIG. 12 and the lock 300 shown in FIGS. 5*a*-*b* constitutes lock no. 3 in FIG. 12. As noted in the table of FIG. 12 this combination of key and lock will define the correct fully inserted position of the key and if the key is provided with a correct code, the key will be able to operate the lock.

Figure 4A:
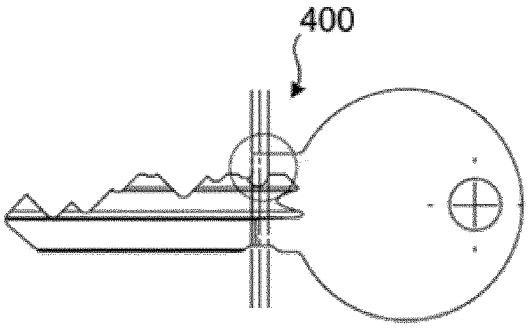
FIG. 4*a* is a side view of the key shown in FIG. 3*a* and FIG. 4*b* is a partial magnification thereof.
Figure 4B:
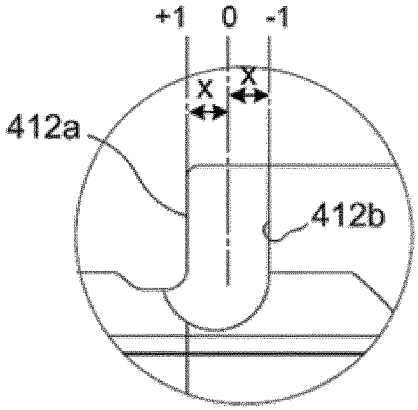
Figure 3A:
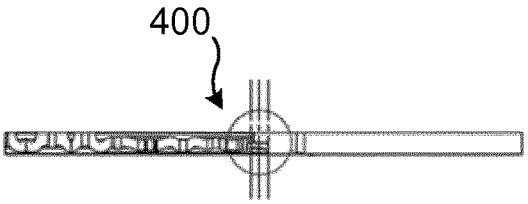
FIG. 3*a* is a top view of key and FIG. 3*b* is a partial magnification thereof.
Figure 3B:
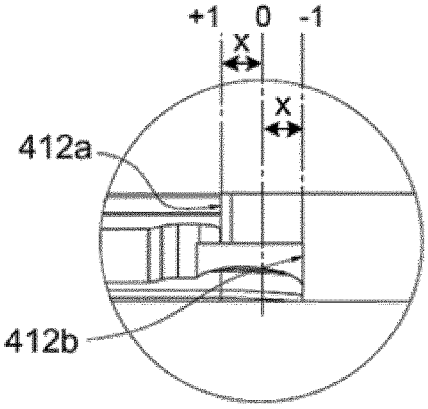

FIGS. 3*a*-4*b* illustrate a key 400 provided with two first stop surface 412*a*, 412*b* arranged generally as the first stop surfaces 212*a*, 212*b* shown in FIG. 1*c*. As indicated in FIGS. 3*b* and 4*b* each first stop surface 412*a*, 412*b* may be positioned at any one of three selectable axial positions. In the figures, the selectable positions are indicated by the reference lines +1, 0 and −1. The reference lines are equidistantly separated by an axial stop separation distance x. Line 0 represents a first reference position, line +1 represents a second axial position which is arranged the distance x in front of line 0 and line −1 represents an axial position which is arranged the stop separation distance x behind line 0. In the shown example first stop surface 412*a* has axial position +1 and first stop surface 412*b* has axial position −1.

Figures 5A, 5B:
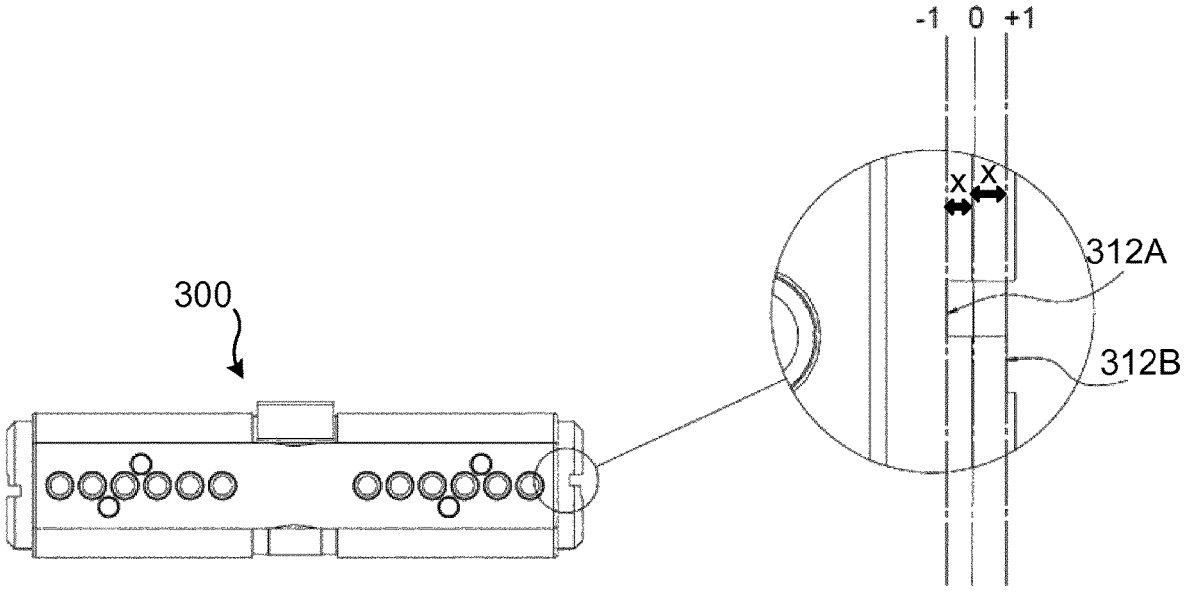
FIG. 5*a* is a top view of a cylinder lock and FIG. 5*b* is a partial magnification thereof.
Figure 6C:
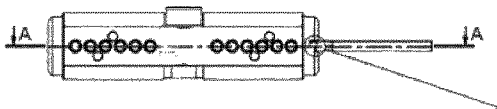
FIG. 6*c* is a top view of the same lock and key and FIG. 6*d* is a partial magnification thereof.
Figure 6A:
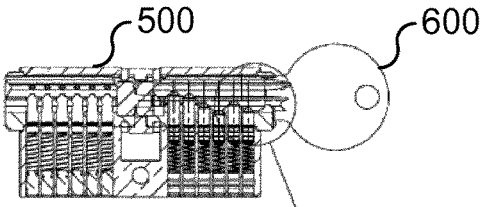
Figure 6B:
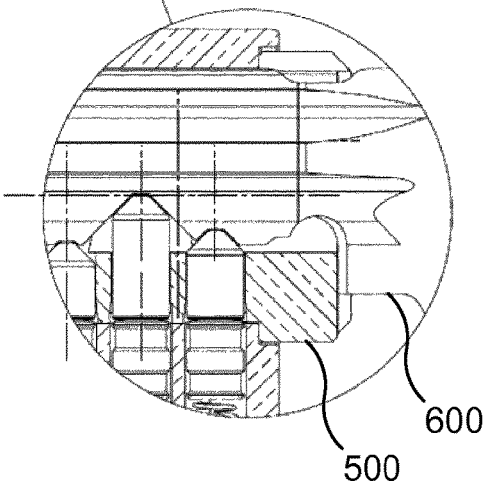
Figure 6D:
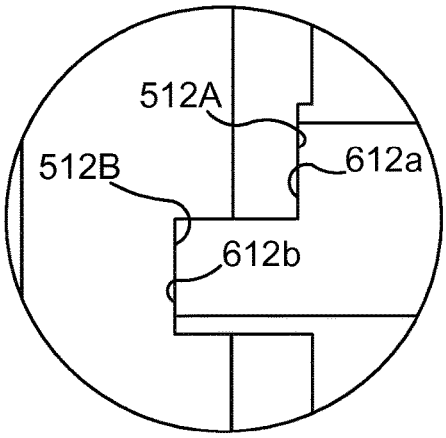

Correspondingly, FIGS. 5*a* and 5*b* illustrate a cylinder 300 and indicate that each second stop surface 312A, 312B may be positioned at any one of three selectable axial positions indicated by reference lines +1, 0 and −1. Also these references lines and the corresponding selectable axial positions are equidistantly separated by the axial stop separation distance x. At the shown example second stop surface 312A is arranged at axial position −1 and second axial position 312B is positioned at axial position +1.

Just as in the example shown in FIGS. 1*a*-*c*, both first stop surfaces 412*a*, 412*b* will thus be in contact with a corresponding second stop surface 312A, 312B when the key 400 is fully inserted in the keyway of the cylinder 300.

FIGS. 8*a*-9*b* illustrate a key 800 and a cylinder 700 which forms part of a system according to the invention. At this system, one of the first stop surface 812*a* of the keys 800 may be positioned at any one axial position of a first set comprising three selectable axial positions, illustrated in the drawings as a=+1, a=0 and a=−1. Just as in the example shown in FIG. 4*b*, the selectable axial positions of the first set are equidistantly separated by the axial distance x. The other first stop surface 812*b* is positioned at one of a second set of selectable axial positions b=+1, b=0 and b=−1. Also these selectable axial positions are separated by axial distance x. However at this embodiment, the first set of selectable positions are offset the second set of selectable positions. I.e. each of the selectable positions a of the first set is axially offset a corresponding axial position b of the second set. In the shown example the first set is positioned offset the second set by a distance x/2.

Figure 8A:
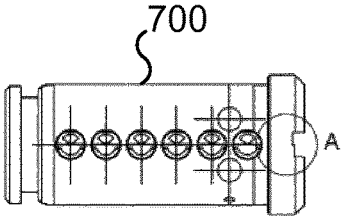
FIG. 8*a* is a top view of a cylinder lock and FIG. 8*b* is a partial magnification thereof.
Figure 8B:
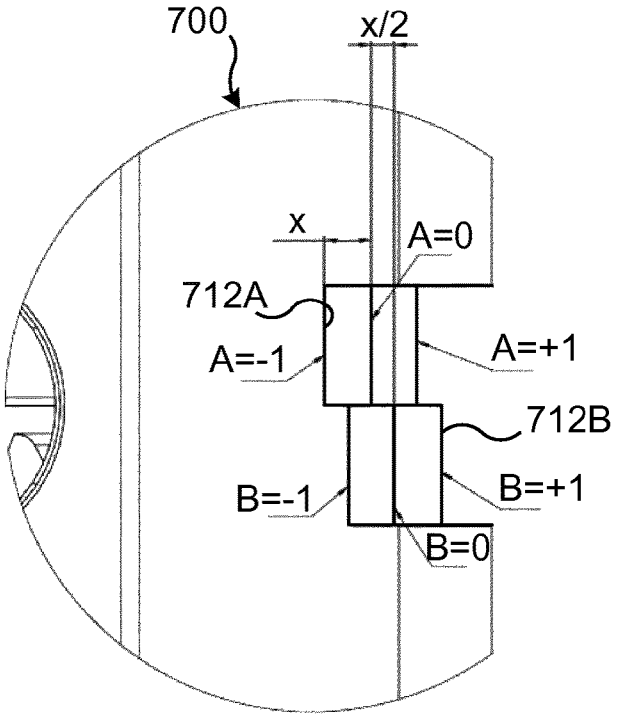
Figure 9A:
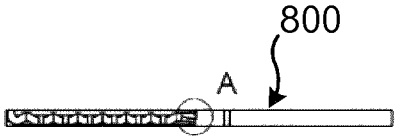
FIG. 9*a* is a top view of a key and FIG. 9*b* is a partial magnification thereof.
Figure 9B:
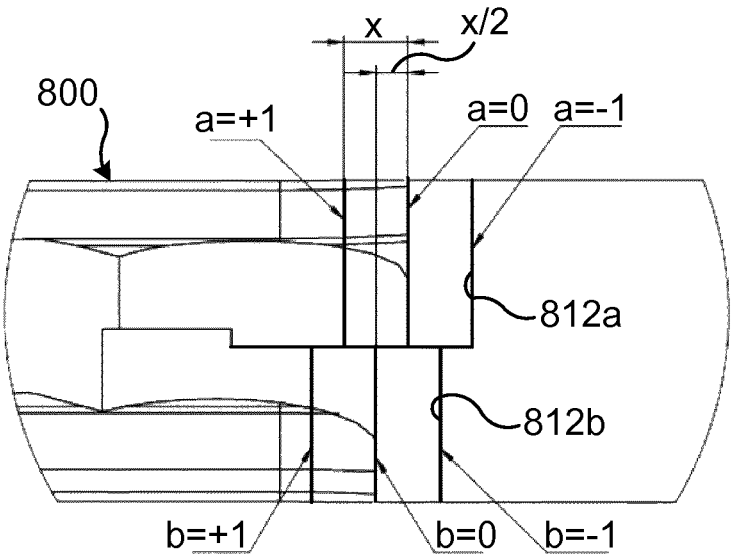

As shown in FIG. 8*b* a cylinders 700 of this system have one second stop surfaces 712A which may be positioned at any one of three selectable axial positions A=+1, A=0, and A=−1 comprised in a first set of selectable axial positions being axially separated by a distance x. The other second stop surface 712B may be positioned at any one of a second set of selectable axial positions B=+1, B=0 and B=−1, also separated by the axial distance x. The first A and second B set of selectable axial positions for the second stop surfaces are offset each other by a distance x/2.

Such an arrangement of the selectable axial positons for the first 812*a*, 812*b* and second 712A, 712B stop surfaces enhances the security of the system since the offset configuration of the selectable axial positions renders it more difficult for unauthorised persons to predict the correct axial positions and reproduce the first stop surfaces correctly at an unauthorized attempt to copy the key.

FIG. 12 is a schematic diagram illustrating how a comparatively small master key system may be configured by utilizing nine cylinder locks and nine keys of the above described type. The keys comprised in the system are thus provided with two first stop surfaces, each of which may be positioned at any one of three selectable axial positions on the key. The cylinder locks comprise plugs provided with two second stop surfaces, each of which may be positioned at any one of three selectable axial positions at the front end of the plugs. In the diagram, the axial positions a, b=+1, 0 and −1 for the two first stop surfaces of each key numbered 1-9 are indicated in the second left column. Correspondingly, the axial positions A, B=+1, 0 and −1 for the two second stop surfaces of each plug numbered 1-9 are indicated in the second upmost row. Squares marked with an "X" indicate compatible combinations of key and plug whereas blank squares represents incompatible combinations. From the diagram it may be seen e.g. that key No. 1 constitutes a master key which is operable in cylinders No. 3 and 6-9, whereas key No. 3 is a master key which is operable in cylinder No 1, 4 and 7 and that key No. 9 is a one to one key operable only in cylinder No. 1.

The invention thus provides for that a comparatively high number of possible permutations are readily achieved merely by varying the axial positions of first and second stop surfaces.

Figure 13A:
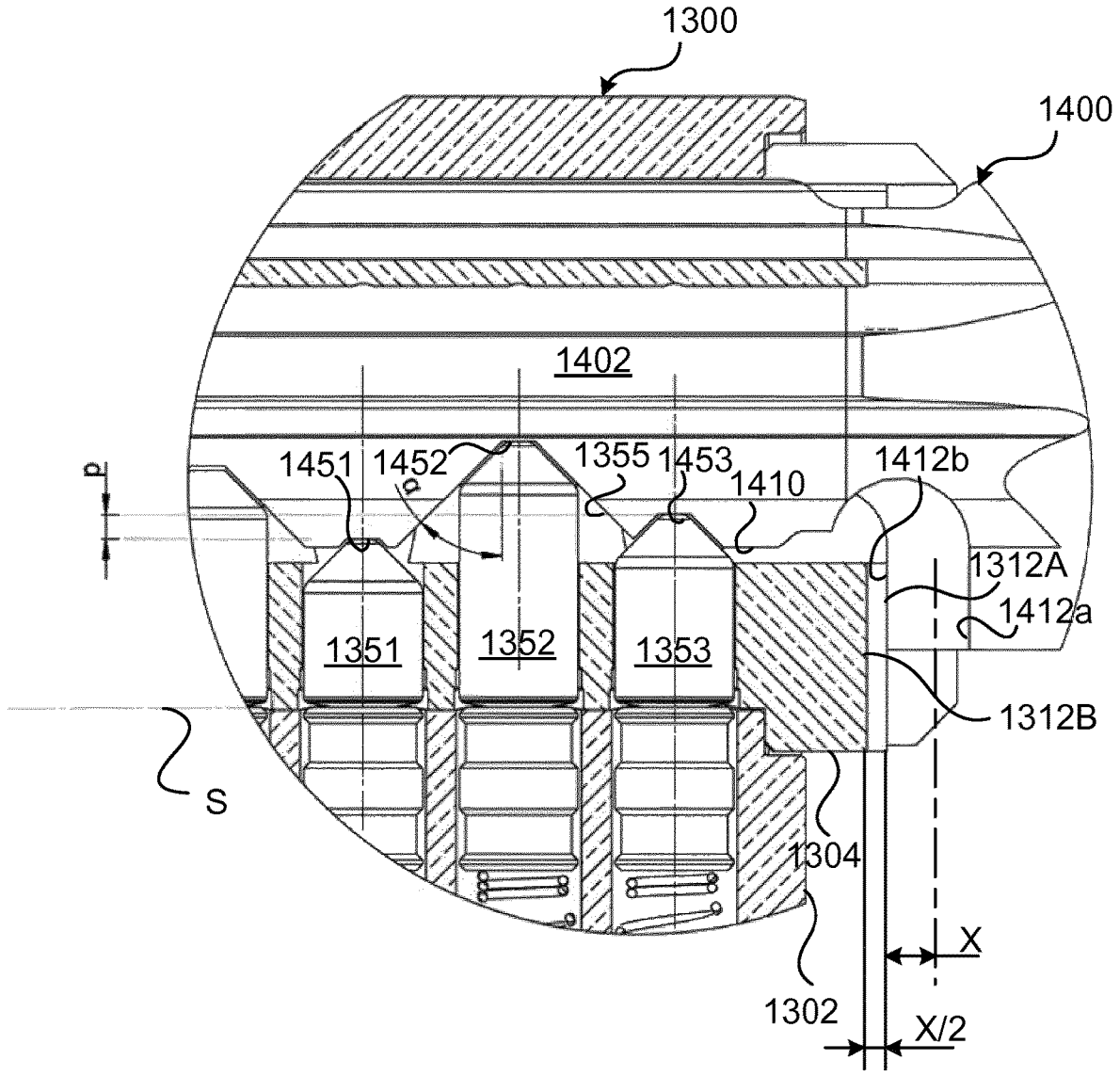
FIG. 13*a* is a longitudinal section in enlarged scale through a cylinder lock with an inserted key and FIG. 13*b* is a corresponding section illustrating the key shown in FIG. 13*a* when inserted into another cylinder lock.

A particular advantage is achieved if the equidistant axial stop separation distance x between the selectable axial positions is chosen with respect to the geometry of the code arranged on the key. FIG. 13*a* shows in enlarged scale a portion of a key blade 1402 of a conventional notched correct key 1400 inserted in the plug 1304 of a pin tumbler lock 1300. The key blade 1402 is provided with a number of code surfaces 1451, 1452, 1453 which are separated axially along the coded edge 1410 of the key blade 1402. The plug is provided with a corresponding number of code sensing pin tumblers 1351, 1352, 1353 which are axially separated by the same distance as the code surfaces, such that each code surface 1451, 1452, 1453 is radially aligned with a corresponding pin tumbler 1351, 1252, 1253 when the correct key is fully inserted. Each code surface is radially positioned at a certain radial position or code height which is selected out of a number of possible radial positions. These selectable radial positions for the code surfaces are radially separated by an equidistant pitch (p). In FIG. 13*a* the pitch (p) is indicated as the radial distance between code surface 1351 and 1353. These two code surfaces 1351, 1353 are thus positioned at the smallest possible radial distance between any code surfaces that are not on the same code height. The code surfaces 1351, 1352, 1353 are further arranged as the respective top of a generally truncated equilateral triangular code cut 1355. Both sides of the triangular cut 1355 exhibits an angle α to the radial direction. This angle α constitutes a code cut angle of the code and is equal for all code surfaces.

The key 1400 is provided with two first stop surfaces 1412*a*, 1412*b*. First stop surface 1412*a* is positioned at one of three possible positions a, which possible positions are equidistantly separated by a stop separation distance x. Correspondingly, first stop surface 1412*b* is positioned at one of three possible positions b, which possible positions are equidistantly separated by a stop separation distance x. The possible positions for the first stop surface 1412*b* are longitudinally offset in relation to the possible positions for the first stop surface 1412*a* by a distance x/2. In the shown example first stop surface 1412*a* is positioned at position a=0 and first stop surface 1412*b* is positioned at position b=+1. The key 1400 is thus a key No. 6 in the table of FIG. 12.

The cylinder lock 1300 comprises a housing 1302 and a plug 1304 which are separated by a shear line S. The plug 1304 is provided with two second stop surfaces 1312A, 1312B arranged at the front end of the plug 1304. Second stop surface 1312A is positioned at one of three possible positions A and second stop surface 1312B is positioned at one of three possible positions B. Possible positions A are mutually separated by equidistant stop surface separation distance x and possible positions B are mutually separated by equidistant stop surface separation distance x. The possible positions B are longitudinally offset in relation to possible positions A by x/2. In the shown example both second stop surfaces 1312A, 1312B are positioned at position A=−1 and B=−1 respectively. As indicated in FIG. 13*a*, second stop surface 1312B is thus longitudinally offset from second stop surface 1312A by x/2. The cylinder lock 1300 is thus a cylinder lock No. 1 in the table of FIG. 12.

Now, it has proven advantageous to set the stop separation distance x as shown in FIGS. 3*b*, 4*b*, 5*b*, 14*a*, 14*b* and discussed above to a certain value with regard to the above described geometry of the key code. In the shown example it is advantageous to set the stop separation distance x to a value which is equal to or greater than half of the pitch p multiplied by tan α, i.e.;

$$x \geq 0.5p \tan \alpha$$

Figure 7C:
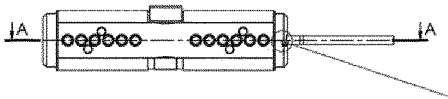
FIG. 7*c* c is a top view of the same lock and key and FIG. 7*d* is a partial magnification thereof.
Figure 7A:
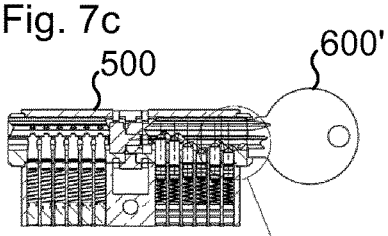
FIG. 7*a* is a longitudinal section through the lock shown in FIG. 6*a* but with another key and FIG. 7*b* is a partial magnification thereof.
Figure 7D:
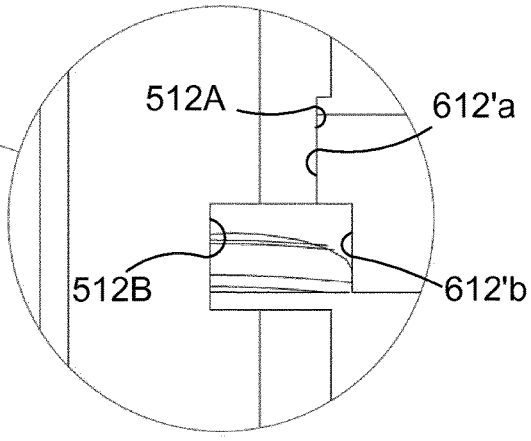
Figure 7B:
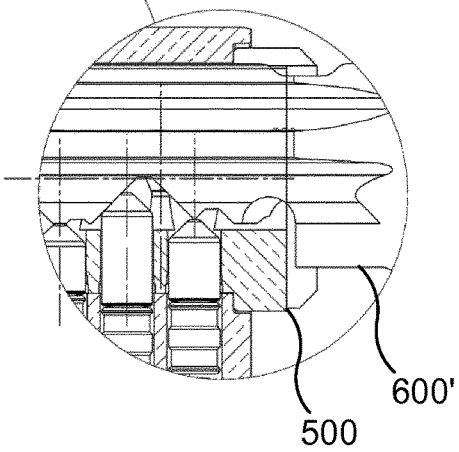

By this means it is assured that the code surfaces of a key comprised in the system but intended not to open this particular lock of the same system will not coincidentally be aligned with any pin tumbler when a key not having the correct first stop surfaces positions in relation to the plug in question is inserted into the plug. Such an incorrect combination is illustrated in FIGS. 7*b* and *d*, where it is seen that the pin tumblers of the cylinder 500 are not aligned with the code surfaces of the key 600, which key does not have first stop surfaces that correspond to the second stop surfaces of the plug 500. This is also shown in greater detail in FIG. 13*b*.

Figure 13B:
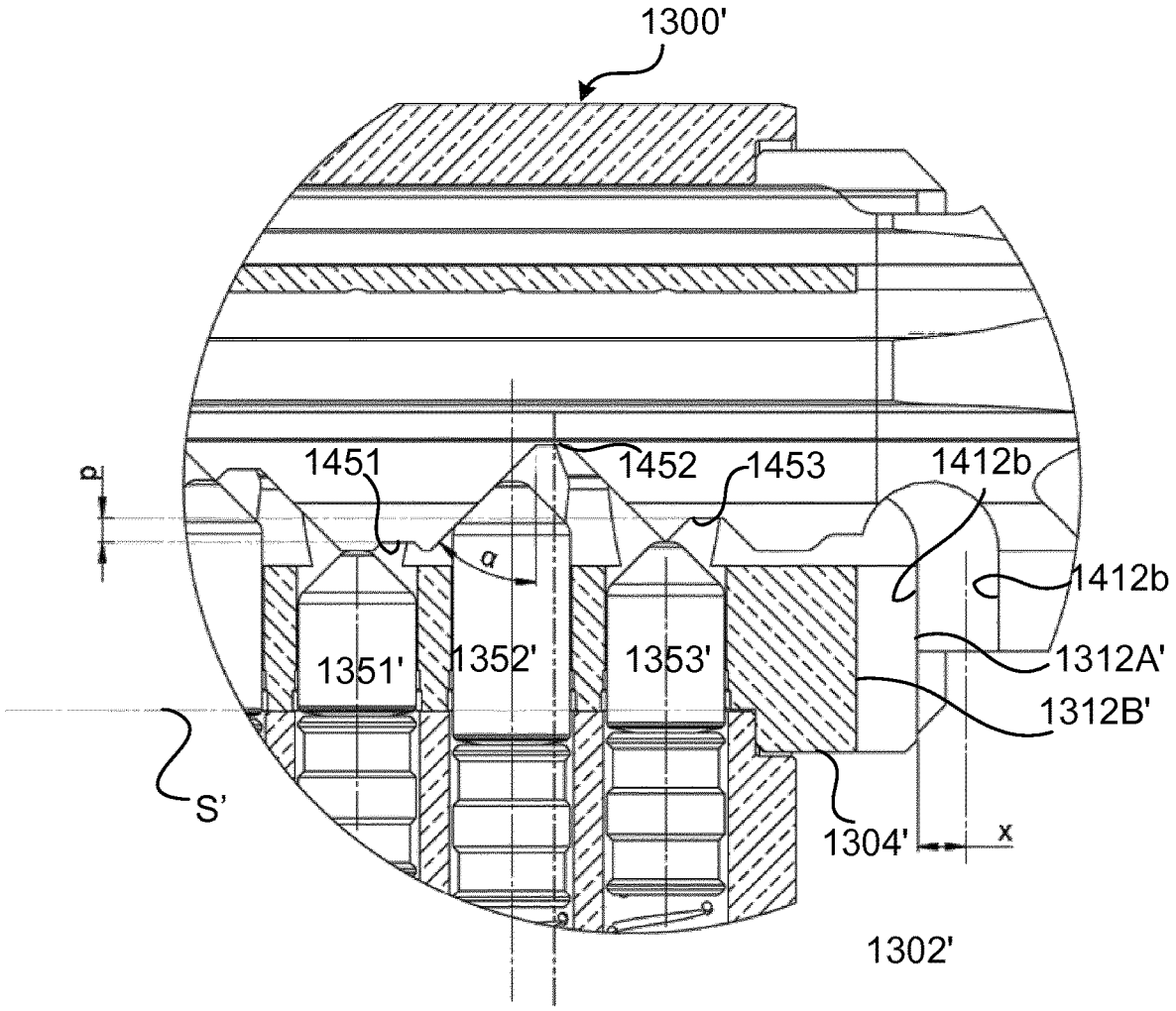

FIG. 13*b* illustrates the key 1300 shown in FIG. 13*a*, when it has been fully inserted into a different cylinder lock 1300' of the same system. Also this cylinder lock 1300 is provided with pin tumblers 1351', 1352', 1353' and with two second stop surfaces 1312A', 1312B'. Since the cylinder lock 1300' is comprised in the same system as cylinder lock 1300 and key 1400 the second stop surface 1312A' is positioned at one of three possible positions A which are mutually separated by the same stop separation distance x as second stop surface 1312A of key 1300. Correspondingly second stop surface 1312B is positioned at one of three possible positions B, which are mutually separated by stop separation distance x. As at cylinder lock 1300 the possible positions B are longitudinally offset to the possible positions B by x/2. At cylinder lock first 1300' first stop surface 1312A' is positioned at position A=−1 and second stop surface 1312B' is positioned at position B=0. The cylinder lock 1300' is thus a cylinder lock No. 2 in the table of FIG. 12. As seen in this table such cylinder locks No. 2 are not compatible with keys No. 6 and thus not with key 1400 shown in FIGS. 14*a* and 14*b*.

A seen both in FIGS. 7*a-b* and 13*a-b*, the misalignment between the code surfaces 1451, 1452, 1453 of the key 1400 and the corresponding pin tumblers 1351', 1352', 1353' causes the pin tumblers to be radially displaced out of their releasing position between the plug 1304' and the cylinder housing 1302'. As seen in FIG. 13*b* all shown pin tumblers 1351', 1352', 1353', intersects the shear line S' whereby rotation of the plug 1304' is not possible. By selecting the stop surface separation distance x, sufficiently large in relation to the code cut angle α and the pitch p, it is assured that the radial displacement of the pin tumblers 1351', 1352', 1353' is large enough to ensure that the pin tumblers are positioned in an interlocking position between the plug 1304' and housing 1302', i.e. a position where the pin tumblers 1351', 1352', 1353' securely intersect the shear line S' between the plug 1304' and the housing 1302'.

If e.g. the code cut angle α is 45° and the stop surface separation distance x is larger than 0.5*p*tan α, the resulting radial displacement of the pin tumbler will be larger than half the pitch. A too small radial displacement could prevent a secure interlocking between the plug and the housing. In particular, manufacturing tolerances and pin tumbler end chamfers or crowning may result in that the pin tumblers, upon rotation of the plug, are forced away from the shear line such that they do not intersect the shear line, thereby incorrectly allowing continued rotation of the plug relative to the housing. With the chosen smallest stop separation distance it is however assured that the pin tumblers will be radially displaced long enough not to allow the pin tumblers to be forced away from the shear line by rotating the key.

Preferably, the stop surface separation distance should also be smaller than a certain value to assure that the pin tumblers are not coincidently displace to the next code level. Advantageous x is chosen smaller or equal to 0.8*p*tan α. By this means it is assured that using a key with incorrect first stop surfaces does not run the risk of the pin tumblers to be radially displaced a full pitch distance where it could coincidently be positioned such that the pin tumbler does not intersect the shear line. If e.g. the code cut angle α is 45° and the code separation distance x is smaller than or equal to 0.8*p*tan α, the pin tumblers will be radially displaced a distance which is smaller than or equal to 0.8*p. At such a limited radial displacement the risk of an end portion of the pin tumblers to be coincidently positioned in proximity to the sear line is eliminated.

Also at dimpled keys, the same principle for setting the stop separation distance x in relation to the code geometry may advantageously be utilized. In such instances the code cut angle α is the angle between the conically sloping code dimple walls and the central axis of the dimpled code recess.

In practice, the code cut angle α is, both at sawn or cut keys and at dimpled keys set within the interval of 40-60°.

Figures 10A, 10B:
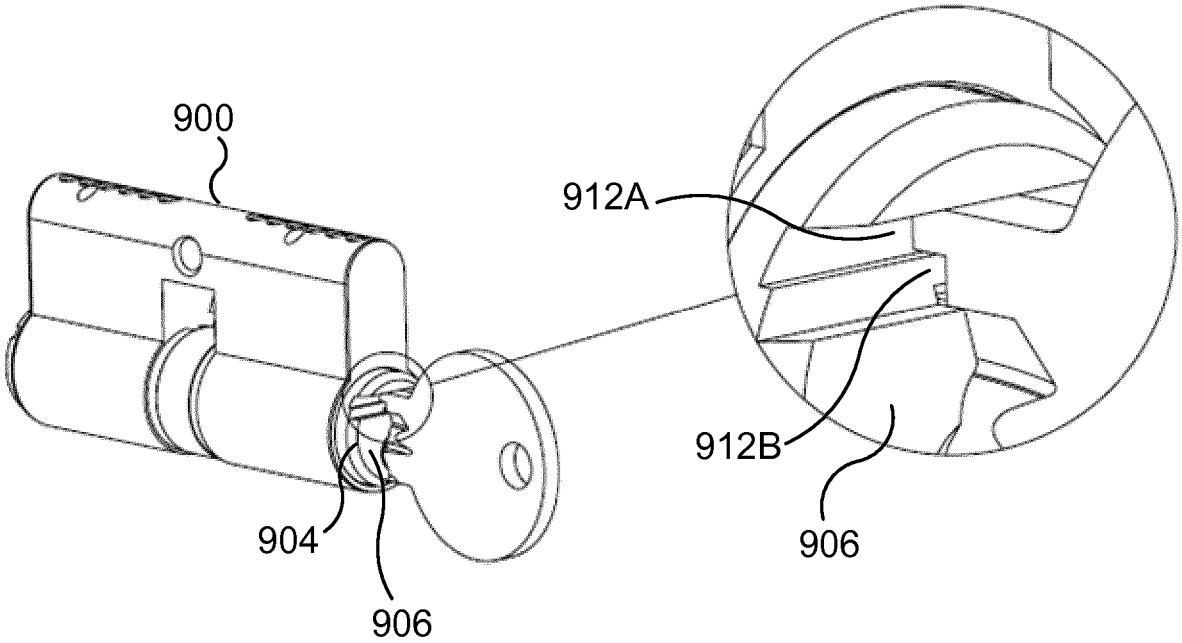
FIG. 10*a* is a perspective view of a cylinder lock with inserted key and FIG. 10*b* is a partial magnification thereof.
Figure 10C:
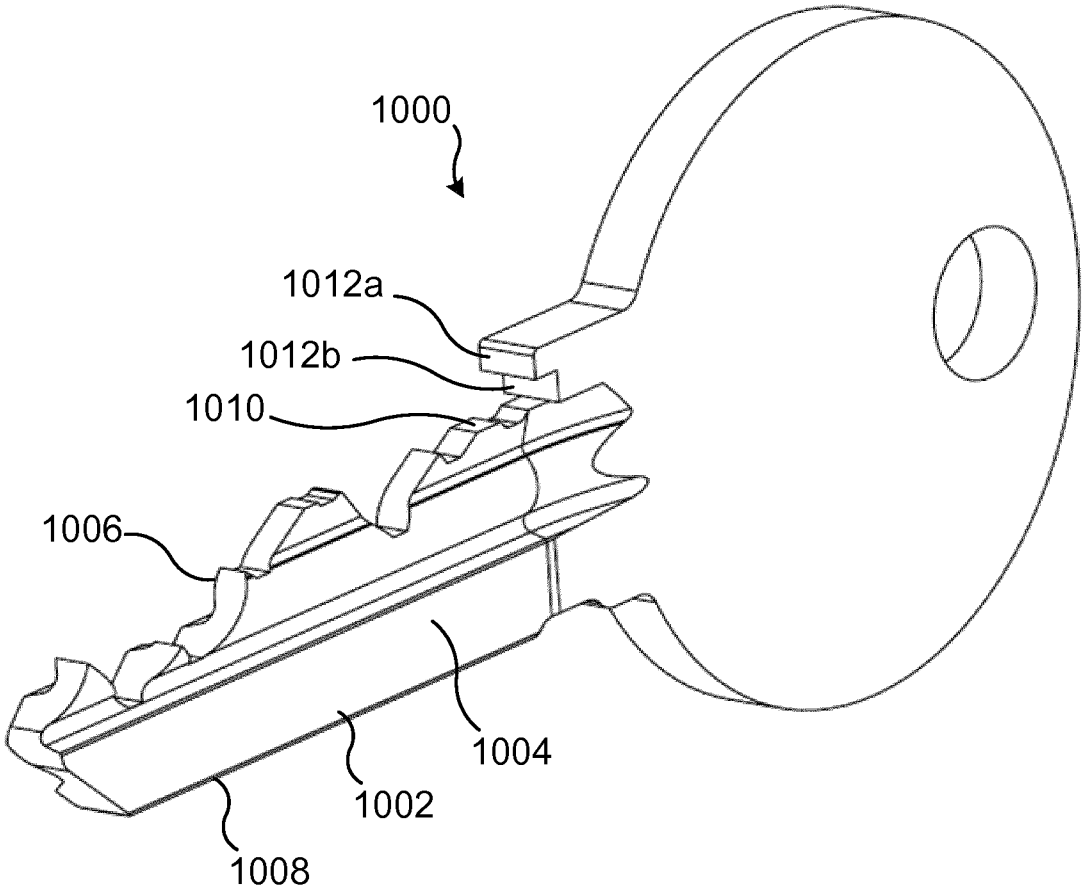
FIG. 10*c* is a perspective view in enlarged scale of the key shown in FIGS. 10*a* and *b*.
Figure 11A:
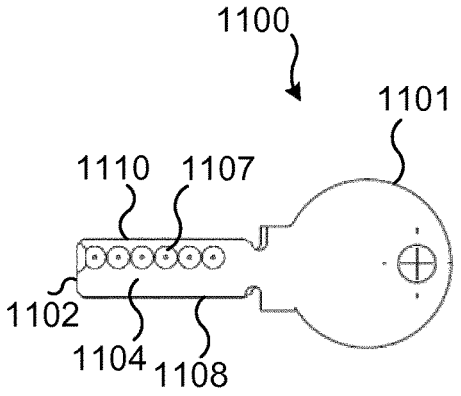
FIG. 11*a-c* are a first side view, an opposite side view and a perspective view respectively of a key.
Figure 11B:
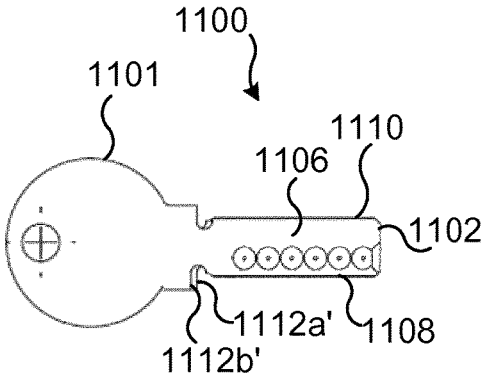
Figure 11D:
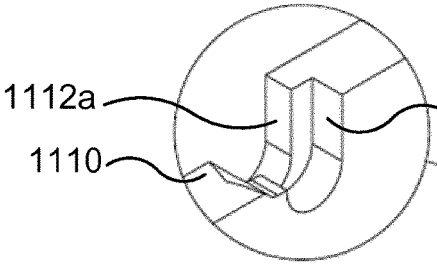
FIG. 11*d* is a partial magnification of that key.
Figure 11C:
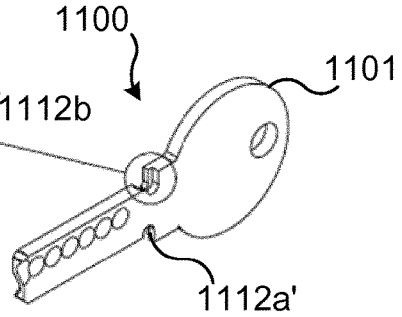

FIGS. 10*a-c* illustrate a cylinder 900 and a key 1000 which form part of a system according to another embodiment of the invention. At this embodiment the cylinder 900 and key 1000 are generally of the same type as described above. Also at this embodiment, two first stop surfaces 1012*a*, 1012*b* are arranged adjacent a common edge 1010 of the key blade 1002. However at this embodiment one 1012*a* of the first stop surfaces is arranged radially outside of the other 1012*b* first stop surface. Both first stop surfaces are planar and parallel with the cross sectional plane of the key blade 1002.

Correspondingly, the cylinder 900 comprises two second stop surfaces 912A, 912B, one 912A of which is arranged radially outside of the other 912B, at the front end 906 of the plug 904. Also at this embodiment the second stop surfaces are defined by respective recesses arranged at the radial end being opposite to an radially open end of the keyway.

FIG. 11*a-d* illustrate a further key 1100 which may form part of a system according to the invention. This key 1100 is a so called reversible dimpled key comprising a key bow 1101 and a key blade 1102. The key blade 1102 exhibits two opposed lateral sides 1104, 1106 provided with code dimples 1107 and two opposed edges 1108, 1110 connecting the lateral sides 1104, 1106. Two primary first stop surfaces 1112*a*, 1112*b* are arranged side by side at either side of an imaginary radial line in proximity to a first edge 1110 of the key blade. Two secondary first stop surfaces 112*a*', 112*b*' are arranged side by side at either side of an imaginary radial line in proximity to the second edge 1108 of the key blade 1102. The secondary first stop surfaces 1112*a*', 1112*b*' are arranged symmetrically to the primary first stop surfaces 1112*a*, 1112*b* with respect to a central axis of the key blade 1102. By this means the reversible key 1100 may be inserted in and operable with a keyway of a plug (not shown) at which keyway second stop surfaces of the type illustrated in FIGS. 1*a* and 1*b* are arranged at the non open radial end of a radially open keyway. By means of the symmetrically arranged primary 1112*a*, 1112*b* and secondary 112*a*', 112*b*' first stop surfaces, the key may be inserted in the keyway and cooperate with the second stop surfaces irrespective if the key is inserted in a first rotational position or a second rotational position being rotated 180° relative to the first rotational position.

FIGS. 14*a*-16*b* illustrate an embodiment where the second stop surfaces 1512A, 1512B are arranged on a separate insert 1560 which is removably fixed to the plug 1504. As best seen in FIG. 14*b* the plug 1504 is here provided with a radially extending T-shaped groove 1570 exhibiting a cross section with a wider portion 1571 and a narrower portion 1572. The groove is arranged at the front end of the plug and extends from the envelope surface of an enlarged extension 1510 of the plug radially towards the rotational axis of the plug 1504, such that a radial inner portion of the groove 1570 debouches in the keyway 1514.

The insert 1560 is provided with a rear portion 1561 and a front portion 1562. The rear portion 1561 is wider than the front portion 1562 and is, when mounted, received in the wider portion 1571 of the T-shaped groove 1570. When mounted, the front portion 1562 is received in the narrower portion 1572 of the T-shaped groove 1570. The radial outer end surface 1563 of the insert 1560 is curved with the same curvature as the envelope surface of the radially enlarged extension 1510 of the plug 1504. When fully mounted a rear portion of the extension 1510 and a portion of the radial outer end surface 1563 are received in a bore 1565 of the housing 1502, such that the insert 1560 is prevented from radial outward movement. Correspondingly, the insert is prevented from moving forwardly by the insert's wider portion 1561 being received in the wider rear portion 1571 of the T-shaped groove 1571. The insert 1560 is thus form-locked in position in the plug 1504 and may rotate together with the plug 1504 within the bore of the housing 1502.

Two second stop surfaces 1512A and 1512B are arranged side-by-side at the front of the insert's 1560 narrower front portion 1562. At the shown example, both second stop surfaces 1512A, 1512B are arranged within the narrower front portion 1572 of the T-shaped groove 1570, such that the second stop surfaces 1512A, 1512B are arranged in a recess at the front end of the plug 1504. However, by varying the axial thickness or length of the insert's narrower front portion 1562, at the position of the second stop surfaces, it is possible to vary the axial positions of the second stop surfaces. It is e.g. possible to arrange either or both second stop surface in axial level with the front surface 1506 of the plug 1504. Either or both second stop surfaces 1512A, 1512B may also be arranged such that they protrude axially in front of the front end surface 1506 of the plug. One second stop surface may also be arranged recessed in the plug and another in level with or protruding in front of the front end surface 1506 of the plug 1504. Additionally the number of second stop surfaces arranged on the insert may also be varied, such that the insert is provided with three, four or more second stop surfaces. Further more, the second stop surfaces may be arranged radially aligned at different radial distances from the rotational axis of the plug. It is also possible that a number of second stop surfaces are arranged at the insert in different combinations of both radially separated and side by side positions. In the shown example both second stop surfaces 1512A, 1512B are arranged on the same insert 1560. It is however also possible to arrange each second stop surface on a separate insert or to arrange different number of stop surfaces on different separate inserts.

Arranging the second stop surfaces on one or a number of removable inserts allows for a number of advantages. E.g. several or all plugs forming part of a system may be identically manufactured to thereafter deciding the desirable second stop surface configuration be selecting one or several corresponding inserts when assembling the cylinder locks. Additionally, the use of removable stop surface inserts also allows for that the second stop surface configuration for a specific lock cylinder may be repeatedly changed.

Figures 14A, 14B:
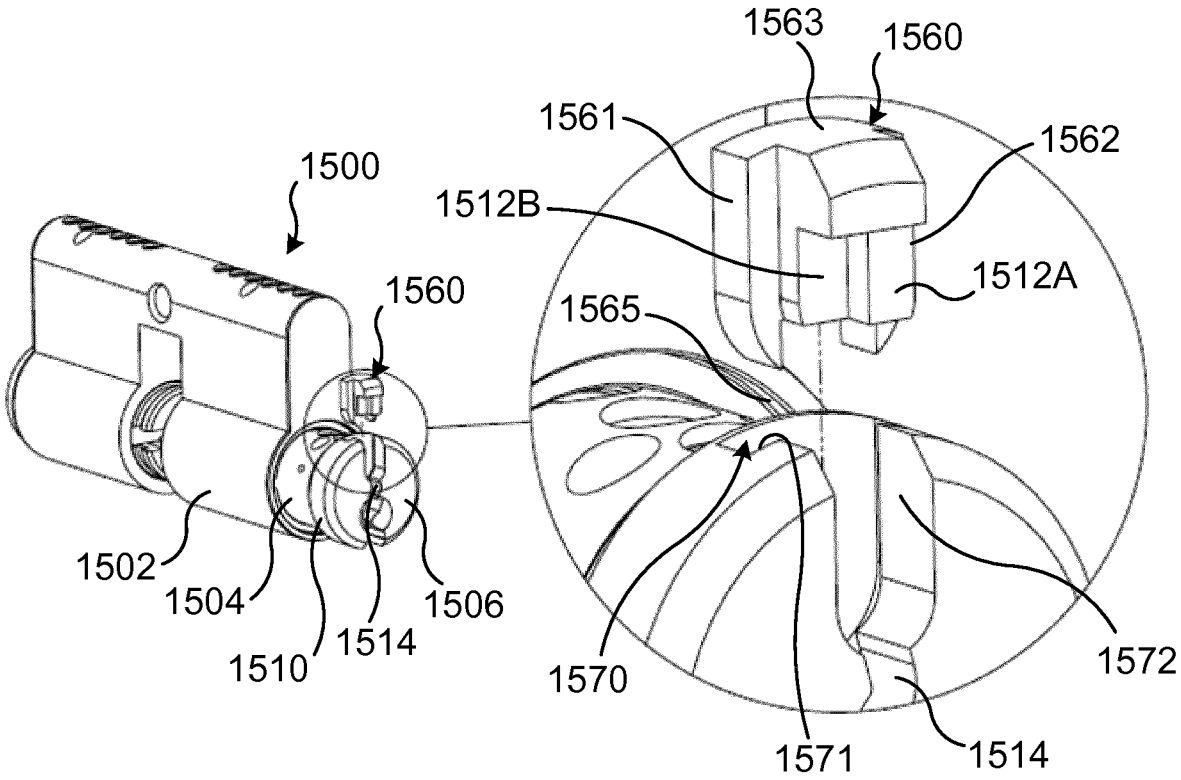
FIG. 14*a* a perspective view of a cylinder lock according to a further embodiment, in a partly disassembled state.
FIG. 14*b* shows a portion in enlarged scale of the lock shown in FIG. 14*a*.
Figures 15A, 15B:
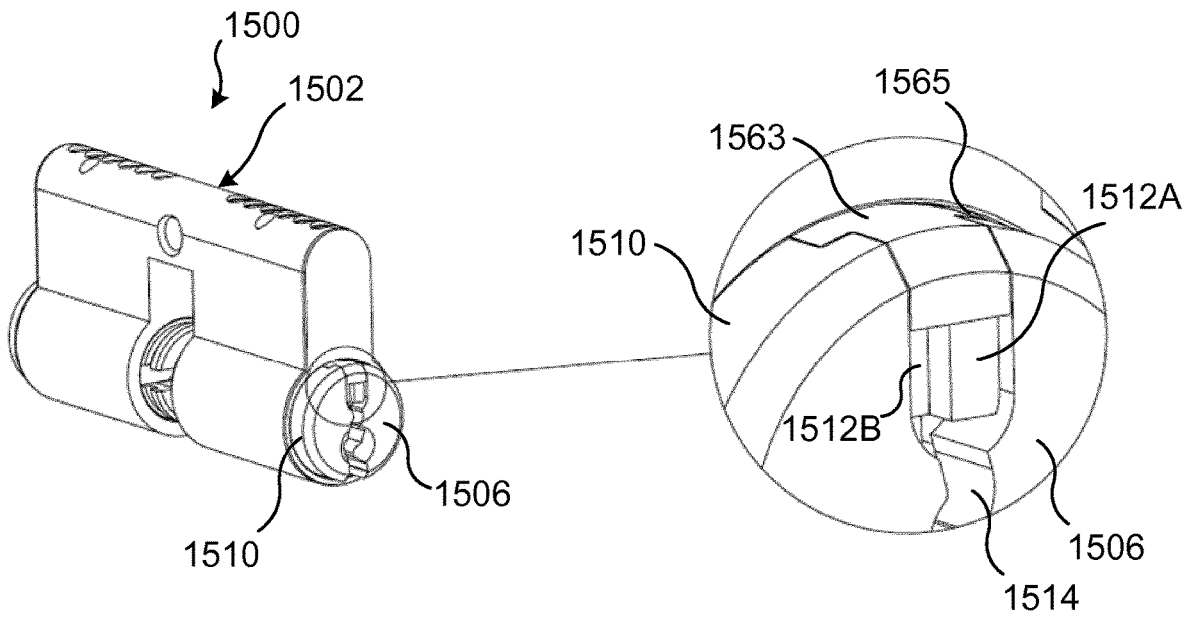
FIG. 15*a* is a perspective view of the lock shown in FIG. 14*a*, when assembled.
FIG. 15*b* shows a portion in enlarged scale of the lock shown in FIG. 15*a*.
Figures 16A, 16B:
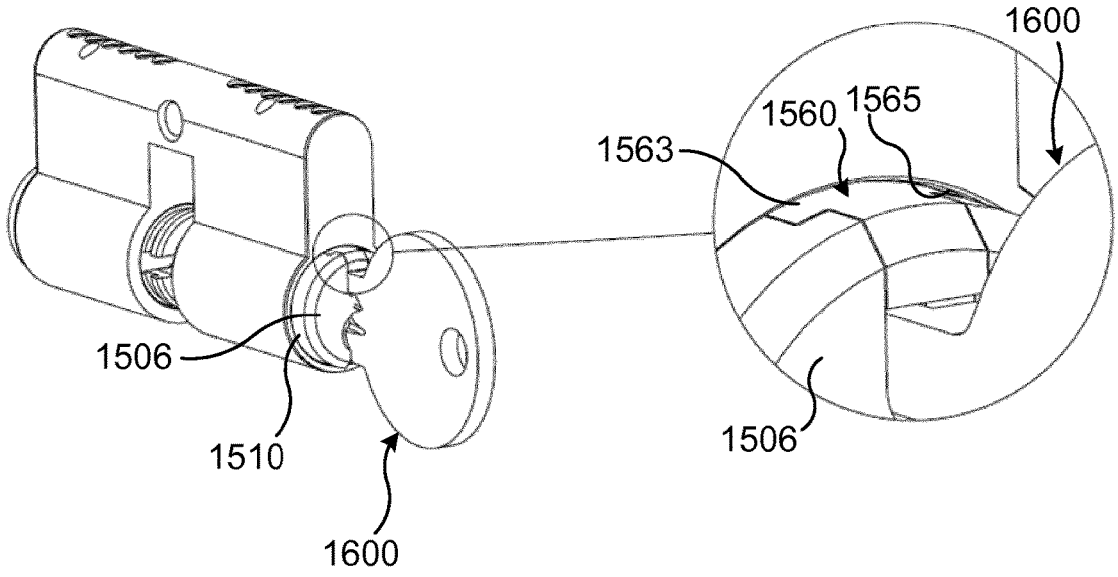
FIG. 16*a* is a perspective view of the lock shown in FIG. 15*a* with a key inserted and FIG. 16*b* shows a portion in enlarged scale thereof.

FIGS. 14*a* and 14*b* illustrate the insert 1560 before being inserted into the plug and before the plug 1504 has been assembled with the housing 1502. FIGS. 15*a* and 15*b* illustrates the same lock fully assembled. FIGS. 16*a* and 16*b* illustrates the same lock with a correct key 1600 inserted FIG. 17*a-c* illustrate a cylinder 1700 comprised in a system according to a further embodiment of the invention. This cylinder 1700 comprises a cylinder housing 1702 and a plug 1704. Two second stop surfaces 1712A, 1712B are arranged at the front end 1706 of the plug 1704. At this embodiment, just as at the cylinder 100 shown in FIG. 1, one second stop surface 1712A is defined by the bottom wall of a recess arranged in the front end 1706 of the plug 1704. The other second stop surface 1712B is defined by a front surface of a forwardly projecting boss, pimple or dog 1718 which is formed integral with the plug 1704 and protrudes forwardly from the front end surface of the plug 1704. An advantage of arranging at least one of the second stop surfaces at such an integral and forwardly projecting boss 1718 is that the number of possible positions for the second stop surfaces may be increased without the need of a forward extension of the entire plug. Thus, a great number of possible stop surface combinations may be achieved while still limiting the space needed to be occupied in front of the front end of the cylinder housing 1702. This constitutes an advantage e.g. when the cylinder lock is to be provided with add on accessories such as protective caps, so called defenders, security escutcheons or the like which are mounted around the front end of the cylinder housing. Since, by this means, only the comparatively small boss 1718 protrudes in front of the front end of the cylinder housing, already existing such accessories may be used without the need of redesign or adaptation.

It is to be understood that the invention is not limited to the exemplifying embodiments shown in the drawings and described above. Instead the invention may freely be varied within the scope of the appended claims. For instance, in the examples given above the keys and plugs are provided with two first stop surfaces and two second stop surface respectively. Naturally, the keys and plugs may be provided with a higher number of first and second stop surfaces. For each compatible key and plug combination the number of first stop surfaces should preferably correspond to the number of second stop surfaces. The invention may also be varied by varying the predetermined number of selectable axial positions for the first and second stop surfaces. For example, the number of selectable axial positons of the first and second stop surfaces may be 2, 4, 5, 6 or any higher integer number. It is also foreseeable that the first stop surfaces may be positioned at any one of a first predetermined number of axial positions whereas the second stop surfaces may be positioned at any one of a second different number of predetermined axial positions. Further more, each of the first stop surfaces may be positioned at any one of a different predetermined number selectable axial positions. Each corresponding second stop surface should then preferably be positioned at any one of a corresponding number of selectable axial positions.

At least one first stop surfaces of the type illustrated in FIG. 1*c* may be combined with at least one first stop surface of the type illustrated in FIG. 10*c*. In such a case one first stop surface may be arranged both radially outwards of another first stop surface and laterally at another side of and imaginary radial line than the other first stop surface. The second stop surfaces should then be arranged mutually in a corresponding manner.

In the shown examples the code surfaces arranged on the sawn keys are formed as the planar bottom surfaces of truncated equilateral triangular depressions in the key blade. The code surfaces may however also be formed with other geometries such as e.g. as a acute or rounded apex of a triangle. At dimpled keys the code surfaces may be formed e.g. by depressions formed as truncated cones, as acute cones, as cones with spherical apexes or as semi spherical depressions.

Here follows a set of embodiments enumerated with roman numerals.

I. A cylinder lock and key system including, cylinder locks of the kind comprising a housing having a cylindrical bore; and a cylindrical plug which is rotatably journaled in the housing about a rotational axis and which exhibits a front end and a keyway which extends axially from an entrance opening (116) at the front end; and keys of the kind comprising a key bow; and a key blade which is insertable in a forward direction to a fully inserted position in the keyway of corresponding locks and rotatable about the rotational axis when inserted; wherein the plugs and keys are provided with cooperating stop surfaces for defining the fully inserted position of the keys in the keyways, which cooperating stop surfaces comprise at least two first stop surfaces arranged at each key, each first stop surface facing forward in the insertion direction and being positioned at a selected one of a predetermined number of selectable axial positions, and at least two second stop surfaces arranged at the front end of each plug, each second stop surface facing forward relative to the plug and being positioned at a selected one of the predetermined number of selectable axial positions; and wherein the first and second stop surfaces are arranged such that at least one first stop surface is in contact with a corresponding second stop surfaces when a correct key is fully inserted in the keyway of a corresponding lock, characterized in that at least two first stop surfaces of each key are arranged adjacent each other and that at least two second stop surfaces of each lock are arranged adjacent each other, at or in proximity to the entrance opening of the keyway.

II. A cylinder lock and key system according to embodiment I, wherein the key blades exhibit two mutually opposing sides and two mutually opposing edges joining the opposing sides and wherein the first stop surfaces are arranged at or in proximity to a common first edge.

III. A cylinder lock and key system according to embodiment I or II, wherein the keyway and the entrance opening of each lock are open in one radial direction and wherein the second stop surfaces are arranged at a radially closed end of the entrance opening being opposite to the radially open end.

IV. A cylinder lock and key system according to embodiments II and III, wherein the first edge of the key blade is an edge which, in the fully inserted position, is positioned proximal to the radially closed end of the keyway.

V. A cylinder lock and key system according to any of embodiments I-IV, wherein the first stop surfaces are arranged mutually side by side on either side of an imaginary radial line of the key blade and the second stop surfaces are arranged mutually side by side on either side of an imaginary radial line of the plug.

VI. A cylinder lock and key system according to any of embodiments I-V, wherein the first stop surfaces are arranged at mutually different radial positions of the key blade and the second stop surfaces are arranged at mutually different radial positions of the plug.

VII. A cylinder lock and key system according to any of embodiments I-VI, wherein the number of selectable axial positions for the first and second stop surfaces are 2-5, preferably 3.

VIII. A cylinder lock and key system according to any of embodiments I-VII, wherein the selectable axial positions for the first and second stop surfaces are equidistantly separated.

IX. A cylinder lock and key system according to any of embodiments I-VIII, wherein the keys are reversible and comprise at least two primary first stop surfaces arranged at or proximity to a first edge of the key blade and at least two secondary first stop surfaces arranged at or proximity a second edge of the key blade, which secondary first stop surfaces are arranged symmetrically to the primary first stop surfaces with respect to a central axis of the key blade.

X. A cylinder lock and key system according to any of embodiments I-IX, wherein at least one second stop surface is arranged in a recess formed in the front end of the plug.

XI. A cylinder and key system according to any of embodiments I-X, wherein the cylinder locks comprise pin tumbler locks or disc tumbler locks and the keys are of the conventional notched key type, dimpled key type, engraved key type, side coded key type or disc cylinder key type.

XII. A cylinder lock and key system according to any of embodiments I-XI, wherein the selectable axial positions for the first and second stop surfaces are equidistantly separated by a stop separation distance; each of the first stop surfaces being positioned at a selected one of the predetermined number of a respective set of selectable axial positions, the selectable positions of one set being axially offset to at least one other set and wherein each of the second stop surfaces are positioned at a selected one of the predetermined number of a respective set of selectable axial positions, the selectable positions of one set being axially offset to at least one other set.

XIII. A cylinder lock and key system, according to embodiment XII, wherein at least two sets of selectable axial positions for the first stop surfaces are axially offset by half the equidistant stop separation distance and wherein at least two sets of selectable axial positions for the second stop surfaces are axially offset by half the equidistant stop separation distance.

XIV. A cylinder lock an key system according to any of embodiments I-XII, wherein at least one second stop surface is arranged on an insert which is removably fixed to the plug.

XV. A cylinder lock and key combination including, a cylinder lock comprising a housing having a cylindrical bore; and a cylindrical plug which is rotatably journaled in the housing about a rotational axis and which exhibits a front end and a keyway which extends axially from an entrance opening at the front end; and a key comprising a key bow; and a key blade which is insertable in a forward direction to a fully inserted position in the keyway of corresponding locks and rotatable about the rotational axis when inserted; wherein the plug and key are provided with cooperating stop surfaces for defining the fully inserted position of the key in the keyway, which cooperating stop surfaces comprise at least two first stop surfaces arranged at the key, each first stop surface facing forward in the insertion direction; and at least two second stop surfaces arranged at the front end of the plug, each second stop surface facing forward relative to the plug; and wherein the first and second stop surfaces are arranged such that at least one first stop surface is in contact with a corresponding second stop surfaces when the key is fully inserted in the keyway of the lock, characterized in that the at least two first stop surfaces are arranged adjacent each other and that the at least two second stop surfaces of the lock are arranged adjacent each other, at or in proximity to the entrance opening of the keyway.

XVI. A key for a cylinder lock and key system according to any of embodiments I-XIV, which key comprises a key bow and a key blade with a code which key blade is insertable to a fully inserted position in a keyway of corresponding locks and rotatable about a rotational axis when inserted which key is provided with at least two first stop surfaces which are arranged to define the fully inserted position of the key in the keyway by contacting corresponding second stop surfaces arranged at a plug of the lock, each first stop surface being positioned at a selected one of a predetermined number of selectable axial positions, characterized in that the first stop surfaces are arranged adjacent each other.

XVII. A key blank for producing a key according to claim XVI, which key blank comprises a key bow arranged in a rear end of the key, a key blade which protrudes forwardly from the key bow and at least two first stop surfaces, each first stop facing forward and being positioned at a selected one of a predetermined number of selectable axial positions, characterized in that the first stop surfaces are arranged adjacent each other.

XVII. A cylinder lock for a system according to any of embodiments I-XIV, which cylinder lock comprises a housing having a cylindrical bore and a cylindrical plug which is rotatably journaled in the housing about a rotational axis and which exhibits a front end and a keyway which extends axially from an entrance opening at the front end, and which is arranged to receive a corresponding key which is insertable to a fully inserted position in the keyway, wherein the plug is provided with at least two second stop surfaces which are arranged to define the fully inserted position of the key in the keyway by contacting corresponding first stop surfaces arranged at the corresponding key, each second stop surface being positioned at a selected one of a predetermined number of selectable axial positions characterized in that the second stop surfaces are arranged adjacent each other, at or in proximity to the entrance opening of the keyway

The invention claimed is:

1. A cylinder lock and key system including, cylinder locks of the kind comprising a housing having a cylindrical bore; and a cylindrical plug which is rotatably journaled in the housing about a rotational axis and which exhibits a front end and a keyway which extends axially from an entrance opening at the front end; and keys of the kind comprising a key bow; and a key blade which is insertable in a forward direction to a fully inserted position in the keyway of corresponding locks and rotatable about the rotational axis when inserted;

wherein the keys are provided with a code and the plugs are provided with code sensing members for detecting the code of an inserted key;

wherein the plugs and keys are provided with cooperating stop surfaces for defining the fully inserted position of the keys in the keyways, which cooperating stop surfaces comprise at least two first stop surfaces arranged at each key, each first stop surface facing forward in the insertion direction and being positioned at a selected one of a predetermined number of selectable axial positions (a, b), and at least two second stop surfaces arranged at the front end of each plug, each second stop surface facing forward relative to the plug and being positioned at a selected one of the predetermined number of selectable axial positions (A, B); and wherein the first and second stop surfaces are arranged such that at least one first stop surface is in contact with a corresponding second stop surface when a correct key is fully inserted in the keyway of a corresponding lock, the code exhibits a code cut angle $\alpha$ and code surfaces which are radially separated by an integer multiple of a code surface pitch, p, and in that the selectable axial positions for the first and second stop surfaces are axially separated by a stop separation distance x, wherein $x \geq 0.5*p*\tan \alpha$.

2. A cylinder lock and key system according to claim 1, wherein the stop separation distance $x \leq 0.8*p*\tan \alpha$.

3. A cylinder lock and key system according to claim 1, wherein at least two first stop surfaces of each key are arranged adjacent each other and at least two second stop surfaces of each lock are arranged adjacent each other, at or in proximity to the entrance opening of the keyway.

4. A cylinder lock and key system according to claim 1, wherein the key blades exhibit two mutually opposing sides and two mutually opposing edges joining the opposing sides and wherein the first stop surfaces are arranged at or in proximity to a common first edge.

5. A cylinder lock and key system according to claim 1, wherein the keyway and the entrance opening of each lock are open in one radial direction and wherein the second stop surfaces are arranged at a radially closed end of the entrance opening being opposite to the radially open end.

6. A cylinder lock and key system according to claim 4, wherein the first edge of the key blade is an edge which, in the fully inserted position, is positioned proximal to a radially closed end of the keyway.

7. A cylinder lock and key system according to claim 1, wherein the first stop surfaces are arranged mutually side by side on either side of an imaginary radial line of the key blade and the second stop surfaces are arranged mutually side by side on either side of an imaginary radial line of the plug.

8. A cylinder lock and key system according to claim 1, wherein the first stop surfaces are arranged at mutually different radial positions of the key blade and the second stop surfaces are arranged at mutually different radial positions of the plug.

9. A cylinder lock and key system according to claim 1, wherein the number of selectable axial positions for the first and second stop surfaces is 2-5.

10. A cylinder lock and key system according to claim 1, wherein the selectable axial positions (a, b, A, B) for the first and second stop surfaces are equidistantly separated.

11. A cylinder lock and key system according to claim 1, wherein the keys are reversible and comprise at least two primary first stop surfaces arranged at or proximity to a first edge of the key blade and at least two secondary first stop surfaces arranged at or proximity a second edge of the key blade, which secondary first stop surfaces are arranged symmetrically to the primary first stop surfaces with respect to a central axis of the key blade.

12. A cylinder lock and key system according to claim 1, wherein at least one second stop surface is arranged in a recess formed in the front end of the plug.

13. A cylinder and key system according to claim 1, wherein the cylinder locks comprise pin tumbler locks or disc tumbler locks and the keys are of the conventional notched key type, dimpled key type, engraved key type, side coded key type or disc cylinder key type.

14. A cylinder lock and key system according to claim 1, wherein the selectable axial positions (a, b, A, B) for the first and second stop surfaces are equidistantly separated by a stop separation distance (x); each of the first stop surfaces being positioned at a selected one of the predetermined number of a respective set of selectable axial positions, the selectable positions (a, b) of one set being axially offset to at least one other set and wherein each of the second stop surfaces positioned at a selected one of the predetermined number of a respective set of selectable axial positions (A, B), the selectable positions of one set being axially offset to at least one other set.

15. A cylinder lock and key system, according to claim 14, wherein at least two sets of selectable axial positions (a, b) for the first stop surfaces are axially offset by half the equidistant stop separation distance (x) and wherein at least two sets of selectable axial positions (A, B) for the second stop surfaces are axially offset by half the equidistant stop separation distance (x).

16. A cylinder lock and key system according to claim 1, wherein at least one second stop surface is arranged on an insert which is removably fixed to the plug.

17. A key for a cylinder lock and key system according to claim 1, which key comprises a key bow and a key blade with a code which is detectable by code sensing members of a cylindrical plug comprised in a cylinder lock of the system, which key blade is insertable to a fully inserted position in a keyway of corresponding locks and rotatable about a rotational axis when inserted which key is provided with at least two first stop surfaces which are arranged to define the fully inserted position of the key in the keyway by contacting corresponding second stop surfaces arranged at a plug of the lock, each first stop surface being positioned at a selected one of a predetermined number of selectable axial positions (a, b), the code exhibits a code cut angle $\alpha$ and code surfaces which are radially separated by an integer multiple of a code surface pitch, p, and in that the selectable axial positions for the first stop surfaces are axially separated by a stop separation distance x, wherein $x \geq 0.5*p*\tan \alpha$.

18. A key blank for producing a key according to claim 17, which key blank comprises a key bow arranged in a rear end of the key, a key blade which protrudes forwardly from the key bow and at least two first stop surfaces, each first stop surface facing forward and being positioned at a selected one of a predetermined number of selectable axial positions (a, b), the first stop surfaces are arranged adjacent each other and that the selectable axial positions (a, b) for the first stop surfaces are axially separated by a stop separation distance x, which is equal or greater than $0.5*p*\tan \alpha$, wherein p is the code surface pitch and $\alpha$ is the code cut angle of a code which is cut into the blade when producing a key from the key blank and which code is detectable by code sensing members of a cylindrical plug comprised in a cylinder lock of the system.

19. A cylinder lock for a system according to claim 1, which cylinder lock comprises a housing having a cylindrical bore and a cylindrical plug with code sensing members for detecting a code of an inserted key, which plug is rotatably journaled in the housing about a rotational axis and which exhibits a front end and a keyway which extends axially from an entrance opening at the front end, and which is arranged to receive a corresponding key which is insertable to a fully inserted position in the keyway, wherein the plug is provided with at least two second stop surfaces which are arranged to define the fully inserted position of the key in the keyway by contacting corresponding first stop surfaces arranged at the corresponding key, each second stop surface being positioned at a selected one of a predetermined number of selectable axial positions (A, B), the second stop surfaces are arranged adjacent each other, at or in proximity to the entrance opening of the keyway and that the selectable axial positions (A, B) for the second stop surfaces are axially separated by a stop separation distance x, which is equal or greater than $0.5*p*\tan \alpha$, wherein p is the code surface pitch and $\alpha$ is the code cut angle of the code of a key for operating the cylinder lock.

20. A cylinder lock and key combination including, a cylinder lock comprising a housing having a cylindrical bore; and a cylindrical plug which is rotatably journaled in the housing about a rotational axis and which exhibits a front end and a keyway which extends axially from an entrance opening at the front end; and a key comprising a key bow; and a key blade which is insertable in a forward direction to a fully inserted position in the keyway of corresponding locks and rotatable about the rotational axis when inserted;

wherein the key is provided with a code and the plug is provided with code sensing members for detecting the code of the inserted key;

wherein the plug and key are provided with cooperating stop surfaces for defining the fully inserted position of the key in the keyway, which cooperating stop surfaces comprise at least two first stop surfaces arranged at the key, each first stop surface facing forward in the insertion direction; and at least two second stop surfaces arranged at the front end of the plug, each second stop surface facing forward relative to the plug; and wherein the first and second stop surfaces are arranged such that at least one first stop surface is in contact with a corresponding second stop surface when the key is fully inserted in the keyway of the lock, the code exhibits a code cut angle $\alpha$ and code surfaces which are radially separated by an integer multiple of a code surface pitch, p, and in that the selectable axial positions for the first and second stop surfaces are axially separated by a stop separation distance x, wherein $x \geq 0.5*p*\tan \alpha$.

* * * * *